US006842602B2

(12) United States Patent
Kudo

(10) Patent No.: US 6,842,602 B2
(45) Date of Patent: Jan. 11, 2005

(54) DRIVE CONTROL DEVICE AND IMAGE FORMING APPARATUS INCLUDING THE SAME

(75) Inventor: Koichi Kudo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/394,170

(22) Filed: Mar. 24, 2003

(65) Prior Publication Data

US 2004/0022557 A1 Feb. 5, 2004

(30) Foreign Application Priority Data

Mar. 22, 2002 (JP) ..... 2002-080077
Mar. 22, 2002 (JP) ..... 2002-080083

(51) Int. Cl.[7] ..... G03G 15/00; G03G 15/16

(52) U.S. Cl. ..... 399/303; 347/116; 399/162; 399/301; 399/313

(58) Field of Search ..... 399/162, 163, 399/165, 301, 302, 303, 308, 313, 394, 396; 347/116; 198/804, 810.01

(56) References Cited

U.S. PATENT DOCUMENTS 5,272,492 A * 12/1993 Castelli ..... 347/116
5,383,014 A * 1/1995 Nowak et al. ..... 399/396 X
5,574,558 A 11/1996 Kudo et al. ..... 356/356
5,579,092 A * 11/1996 Isobe et al. ..... 347/116 X
5,729,024 A 3/1998 Baba et al. ..... 250/559.36
5,818,062 A 10/1998 Baba et al. ..... 250/559.36
5,929,436 A 7/1999 Baba et al. ..... 250/234
6,252,682 B1 6/2001 Baba et al. ..... 358/488
6,336,019 B2 * 1/2002 Castelli et al. ..... 399/162
6,360,064 B1 * 3/2002 Regelsberger et al. ..... 399/162

FOREIGN PATENT DOCUMENTS

JP 62-059973 * 3/1987
JP 2000-132047 * 5/2000

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A device for controlling the drive of an endless movable member of the present invention includes a mark sensor responsive to a plurality of marks continuously positioned on the movable member at preselected intervals in the direction of movement of the movable member. A speed/position controller controls either one of speed and position by using the output of the mark sensor. A discontinuity sensing circuit determines whether or not a discontinuous portion in which a distance between nearby marks does not lie in a preselected range is present in a sensing region assigned to the mark sensor. The speed/position controller varies speed control or position control in accordance with the output of the discontinuity sensing circuit.

42 Claims, 31 Drawing Sheets

DRIVE CONTROL DEVICE AND IMAGE FORMING APPARATUS INCLUDING THE SAME

BACKGROUND OF THE INVENTION

1. Field of the Invention

The present invention relates to a drive control device for causing an endless belt, drum member or similar endless movable member to perform adequate endless movement and a copier, printer, facsimile apparatus or similar image forming apparatus including the same.

2. Description of the Background Art

A drive control device for the above application is customary with a photoconductive drum, intermediate image transfer belt or similar endless movable member joining in an image forming process. When such an endless movable member is driven, it is necessary to accurately position an image on the surface of the movable member or a sheet or recording medium being conveyed by the movable member. It follows that the movement of the movable member for a unit period of time or the preselected point of the movable member at a preselected time must be controlled with high accuracy. In practice, however, the moving speed of the movable member is apt to vary due to various factors including a load exerted by a member contacting the movable member and cannot be fully controlled. It is therefore difficult to execute accurate control over the movement or the position of the movable member.

In light of the above, Japanese Patent No. 3,107,259, for example, discloses a control device configured to control the angular velocity of a drive source in accordance with the angular velocity of a photoconductive drum sensed by a rotary encoder, which is directly connected to the shaft of the drum. Because the photoconductive drum is affixed to the shaft, the moving speed of the surface of the drum and the angular velocity of the shaft are not shifted from each other. Therefore, the control device can execute accurate drive control with a member affixed to a shaft like the photoconductive drum.

However, the control device taught in the above document does not execute drive control on the basis of the movement or the position of the drum, which is the subject of control. Accurate drive control is not available with the control device when a photoconductive belt or an intermediate image transfer belt or similar endless belt member is not directly connected to a drive shaft driven by a drive source.

On the other hand, Japanese Patent Laid-Open Publication Nos. 9-114348 and 6-263281, for example, each disclose a drive control device of the type forming marks on the outer or the inner surface of an endless belt member and feeding back the output of a mark sensor responsive to drive control. The drive control devices taught in these documents directly observe the behavior of the belt member itself and can therefore execute more accurate drive control than the control device of Japanese Patent No. 3,107,259.

More specifically, the drive control device taught in Laid-Open Publication No. 9-114348 includes a mark sensor responsive to a plurality of marks formed on a sheet conveying belt at preselected intervals in the direction of movement of the belt. The drive control device controls the drive of the belt in accordance with data produced by sampling the output of the mark sensor. More specifically, the drive control device calculates the distance of movement of the belt and a mean speed in a preselected period and controls the drive of the belt in accordance with the calculated distance and mean speed.

The drive control stated above is effective so long as signals are output at preselected intervals like the outputs of a rotary encoder. However, it is extremely difficult to form marks on the belt member at preselected intervals although the document does not show or describe a mark forming method specifically. For example, when the belt member is produced by a mold formed with projections and recesses for forming the marks, the belt member is generally pulled out of the mold and then subject to annealing. If the belt material is not uniformly heated during annealing, then the contraction ratio of the entire belt becomes irregular and prevents the distance between nearby marks from being uniform. Moreover, strain produced in the belt member after molding makes the contraction ratio and therefore the distance between nearby marks irregular.

To form marks on an endless belt member, the marks may be printed, adhered or otherwise put on the belt member. When the marks are so put on the belt member after molding, the non-uniform contraction distribution of the belt member does not effect the distance between nearby belts. However, as for the production of endless belt members, the tolerance of circumference length is generally selected to fall between 0.2% and 0.3% or so. Therefore, if the circumference of a belt member is 500 mm long, then the tolerance amounts to 1 mm or above. Consequently, some of belt members produced differ in circumferential length from the other belt members by 1 mm or more. Such a difference in circumferential length makes it extremely difficult to connect a seam portion between the beginning and the end of continuous marks such that the seam portion has the same interval as the continuous mark portion.

In the above circumstances, the continuous marks include a discontinuous portion in which the distance between nearby marks differs from the distance between the other marks. The discontinuous portion directly translates into a mark sensing error or unstable drive control. When a PLL (Phase Locked Loop) circuit is used to cause an endless belt member to move at constant speed, a reference signal and a comparison signal derived from the marks are compared in phase in the PLL circuit. At this instant, if a mark sensing error occurs or if mark sensing timing is noticeably shifted, then the phase of the reference signal and that of the comparison signal are noticeably shifted from each other, resulting in unstable control. This problem arises even when the endless drive member to be controlled is implemented as a drum member.

Technologies relating to the present invention are also disclosed in, e.g., Japanese Patent Laid-Open Publication Nos. 2002-108169, 2002-136164 and 2002-238274.

SUMMARY OF THE INVENTION

It is an object of the present invention to provide a drive control device capable of executing, even when marks continuously put on an endless movable member at preselected intervals in the direction of movement include a discontinuous portion not lying in a preselected range, adequate control over the drive of the movable member, and an image forming apparatus including the same.

A device for controlling the drive of an endless movable member of the present invention includes a mark sensor responsive to a plurality of marks continuously positioned on the movable member at preselected intervals in the direction of movement of the movable member. A speed/position controller controls either one of speed and position by using the output of the mark sensor. A discontinuity sensing circuit determines whether or not a discontinuous portion in which a distance between nearby marks does not lie in a preselected range is present in a sensing region assigned to the mark sensor. The speed/position controller varies speed control or position control in accordance with the output of the discontinuity sensing circuit.

An image forming apparatus including the device described above is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
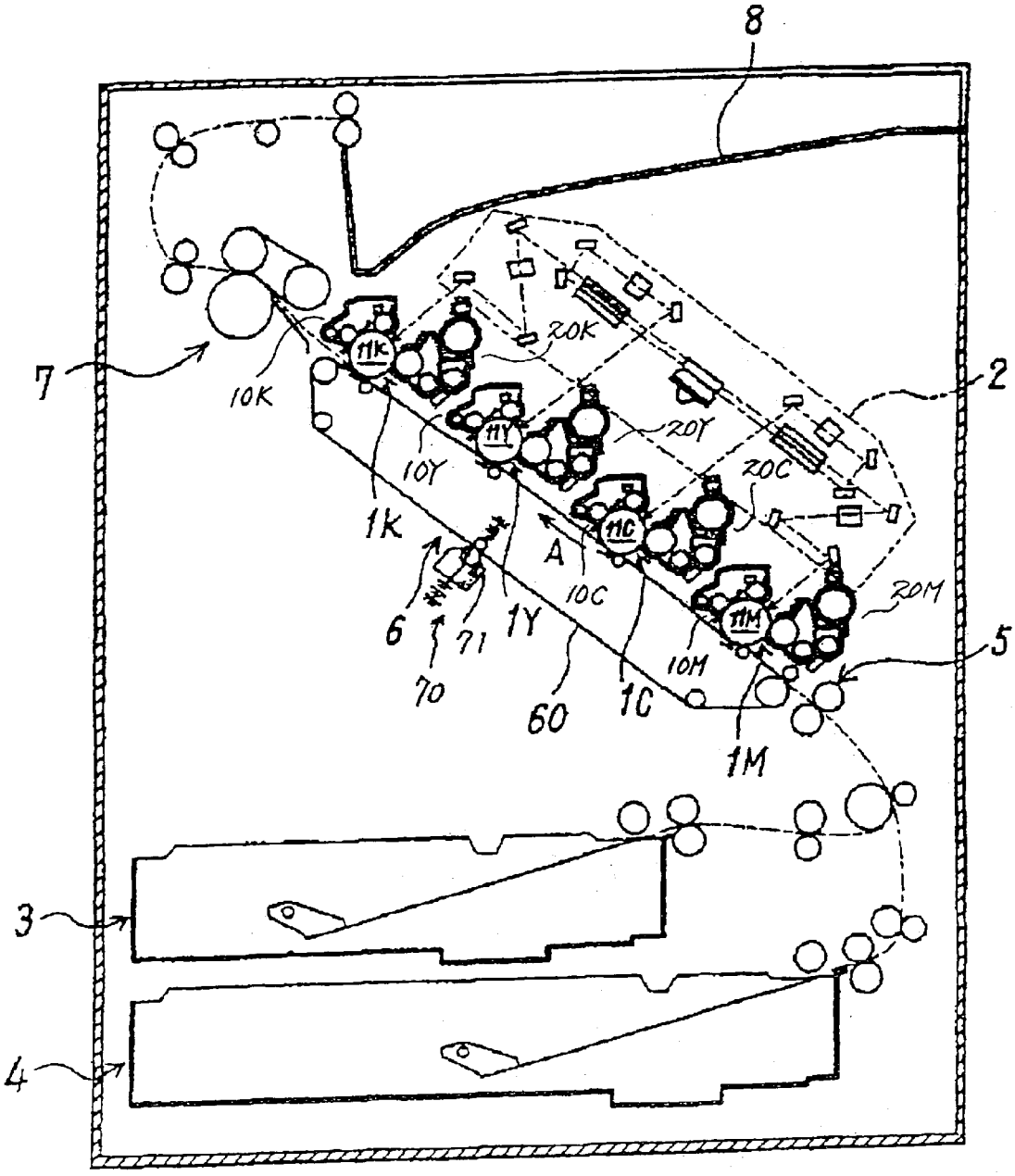
FIG. 1 is a view showing an image forming apparatus embodying the present invention.

Referring to FIG. 1 of the drawings, an image forming apparatus embodying the present invention is shown and implemented as a color laser printer by way of example. As shown, the color laser printer includes four image forming means 1M, 1C, 1Y and 1K for forming a magenta (M), a cyan (C), a yellow (Y) and a black (K) toner image, respectively. The image forming means 1M through 1K are sequentially arranged in this order in a direction A in which a sheet or recording medium is conveyed. The image forming means 1M, 1C, 1Y and 1K respectively include drum units or image carrier units 10M, 10C, 10Y and 10K respectively including photoconductive drums or image carriers 11M, 11C, 11Y and 11K and developing units 20M, 20C, 20Y and 20K. The drum units 10M through 10K are arranged such that the axes of the drums 11M through 11K are parallel to each other and positioned at a preselected pitch in the direction of sheet conveyance A.

The laser printer further includes an optical writing unit 2, sheet cassettes 3 and 4, an image transfer unit 6 including a belt 60, a registration roller pair 5, a fixing unit 7 using a belt, and a print tray 8. The belt or endless movable member 60 conveys a sheet via consecutive image transfer positions where the drums 11M through 11K are located. The registration roller pair 5 conveys a sheet to the belt 60 at preselected timing. The laser printer additionally includes a manual feed tray, toner containers, a waste toner bottle, a duplex print unit and a power supply unit although not shown specifically.

The optical writing unit 2 includes laser diodes or light sources, a polygonal mirror, f-θ lenses and mirrors and scans the surfaces of the drums 11M through 11K with laser beams in accordance with image data.

A path along which a sheet is conveyed is indicated by a dash-and-dots line in FIG. 1. A sheet fed from either one of the sheet cassettes 3 and 4 is conveyed to the registration roller pair 5 by feed rollers while being guided by a guide not shown. The registration roller pair 5 stops the sheet to correct skew and then drives it toward the belt 60 at preselected timing. As the belt 60 conveys the sheet via the consecutive image transfer positions mentioned earlier, toner images formed on the drums 11M through 11K by the image forming means 1M through 1K, respectively, are sequentially transferred to the sheet one above the other, completing a color image on the sheet. Subsequently, after the toner image has been fixed on the sheet by the fixing unit 7, the sheet or print is driven out to the print tray 8.

Figure 2:
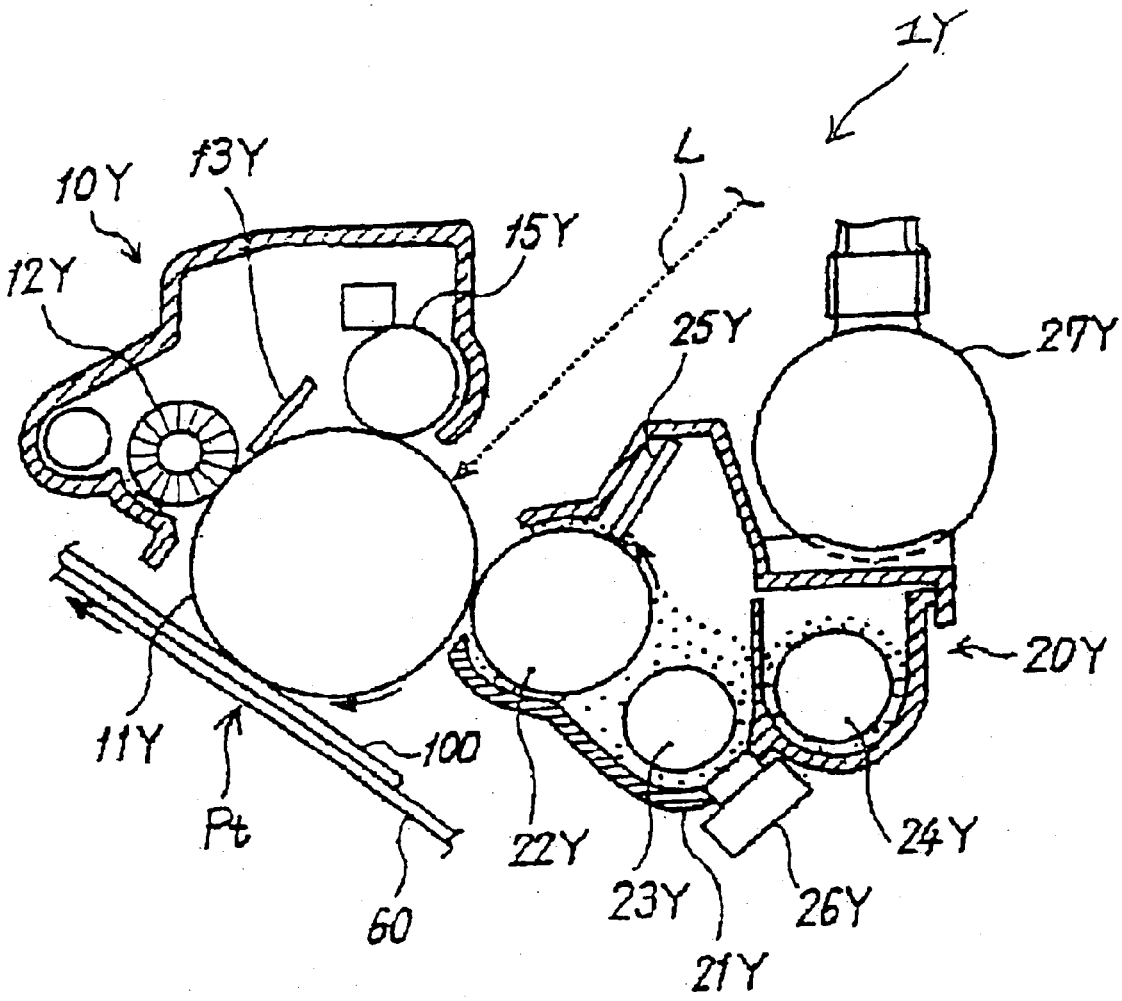
FIG. 2 is a fragmentary view showing image forming means included in the illustrative embodiment.

The image forming means 1M through 1K are identical in configuration except for the color of toner stored therein. FIG. 2 shows the yellow image forming means 1Y in detail by way of example. As shown, the drum unit 10Y of the image forming means 1Y includes, in addition to the drum 11Y, a cleaning blade or cleaning means 13Y for cleaning the surface of the drum 11Y and a charge roller for uniformly charging the surface of the drum 11Y. A brush roller 12Y coats a lubricant on the surface of the drum 11Y while discharging the drum surface. The brush roller 12Y is made up of a brush portion implemented by conductive fibers and a metallic core connected to a power supply that applies a discharge bias.

In operation, the charge roller 15Y applied with a voltage uniformly charges the surface of the drum. The optical writing unit 2 scans the charged surface of the drum 11Y with a laser beam L modulated in accordance with image data, thereby forming a latent image on the drum 11Y. The developing unit 20Y, which will be described more specifically later, develops the latent image with yellow toner to thereby produce a yellow toner image. The toner image is transferred from the drum 11Y to a sheet 100 at an image transfer position Pt via which the belt 60 conveys the sheet 100. After the image transfer, the brush roller 12Y coats a preselected amount of lubricant on the surface of the drum 11Y while discharging the drum surface. Subsequently, the cleaning blade 13Y cleans the surface of the drum 11Y to thereby prepare it for the next image forming cycle.

The developing unit 20Y stores a developer made up of magnetic carrier grains and toner grains including negatively charged toner grains, i.e., a two-ingredient type developer. The developing unit 20Y includes a case 21Y accommodating a developing sleeve or developer carrier 22Y, screws 23Y and 24Y, a doctor blade or metering member 25Y, a toner content sensor or T sensor 26Y, and a powder pump 27Y. The developing roller 22Y is partly exposed to the outside via an opening formed in the case 21Y.

The screws 23Y and 24Y convey the developer stored in the case 21Y while agitating and frictionally charging it. The charged developer is partly deposited on the surface of the developing roller 22Y, metered by the doctor blade 25Y, and then conveyed to a developing position where the roller 22Y faces the drum 11Y. At the developing position, the charged toner of the developer is transferred from the developing roller 22Y to the latent image formed on the drum 11, thereby developing the latent image. The toner content sensor 26Y senses the toner content of the developer present in the case 21Y. The powder pump 27Y replenishes fresh toner to the case 21Y, as needed.

Figure 3:
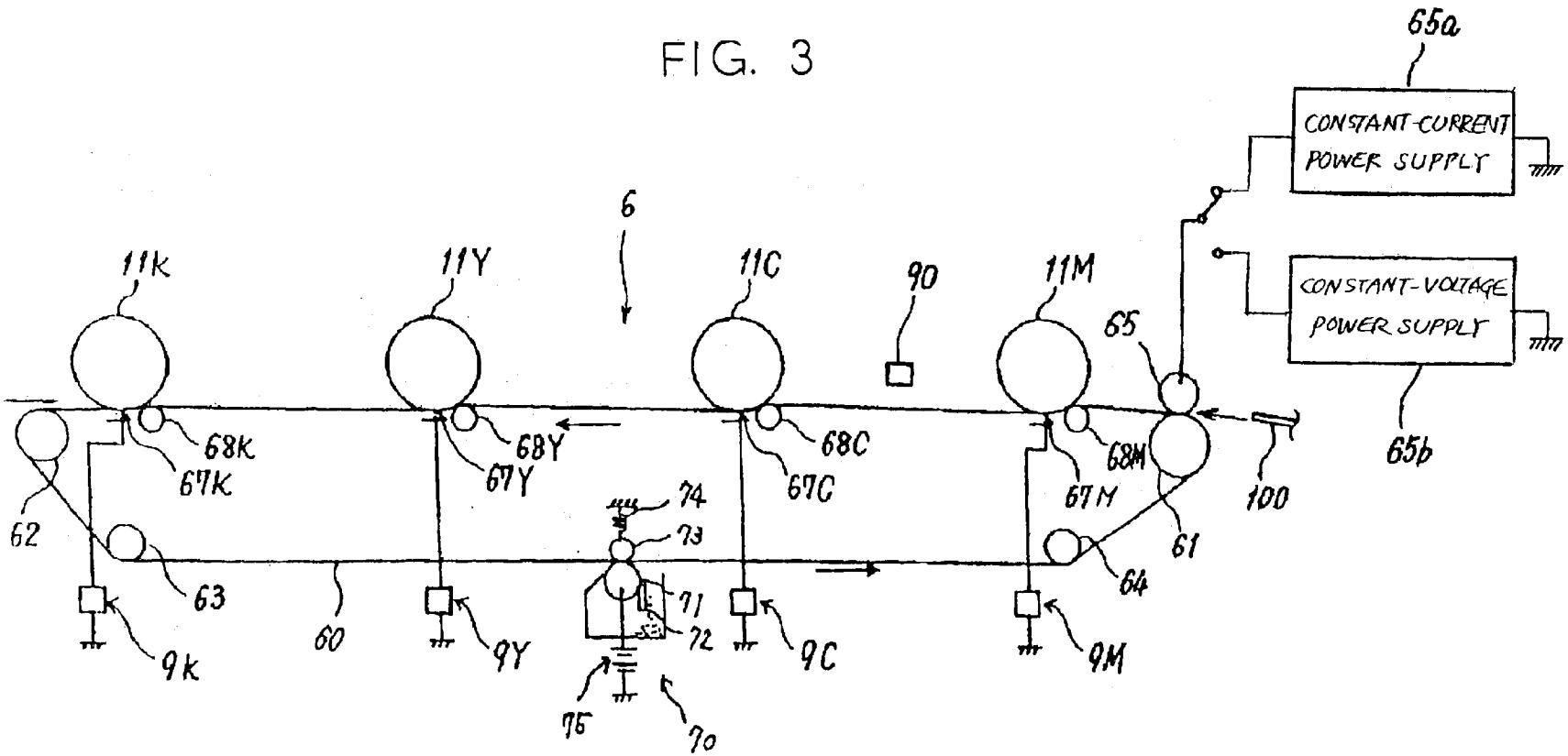
FIG. 3 is a view showing the general configuration of an image transfer unit included in the illustrative embodiment.

FIG. 3 shows the general configuration of the image transfer unit 6. The belt 60 may be formed of PVDF (polyvinylidene fluoride) by way of example. As shown in FIG. 3, the belt 60 is passed over four grounded rollers 61, 62, 63 and 64. The roller 62 positioned at the most downstream side in the direction of sheet conveyance is implemented as a drive roller for driving the belt 60 by friction and connected to a belt motor not shown. When the drive roller 62 causes the belt 60 to move in a direction indicated by an arrow, the belt 60 conveys the sheet 100 via the consecutive image transfer positions where the drums 11M through 11K are positioned.

In the image transfer unit 6, bias applying members or electric field forming means 67M, 67C, 67Y and 67K are held in contact with the inner surface of the belt 60 while facing the drums 11M, 11C, 11Y and 11K, respectively. The bias applying members 67M through 67K and drums 11M through 11K form nips for image transfer therebetween. In the illustrative embodiment, the bias applying members 67M through 67K each are implemented as a stationary brush formed of Mylar. Bias power supplies 9M, 9C, 9Y and 9K for image transfer apply positive biases opposite in polarity to the toner to the bias applying members 67M, 67C, 67Y and 67K, respectively. The biases thus applied via the bias applying members 67M through 67K each form an electric field of preselected strength between the belt 60 and associated one of the drums 11M through 11K.

The belt 60 is constantly pressed against the drums 11M, 11C, 11Y and 11K by backup rollers 68M, 68C, 68M and 68K, respectively. In this condition, the belt 60 is wrapped around part of each drum 11 at the upstream side of the image transfer position where the drum 11 is positioned. This increases the contact pressure to act on the sheet 100 and drum 11 at each nip for image transfer, thereby promoting efficient image transfer.

Further, in the image transfer unit 6, an adhesion roller or electrode member 65 faces the roller 61 via the belt 60 and is held in contact with the belt 60. The adhesion roller 65 is made up of a metallic core and an elastic layer covering the core and formed of a conductive foam material. For the elastic layer, use may be made of chloroprene rubber having resistivity of $10^5$ Ω·cm by way of example.

A power supply 65*a* for adhesion and a power supply 65*b* for polarity inversion, which constitute bias applying means, each apply a particular bias voltage to the adhesion roller 65. More specifically, the power supply 65*a* is a constant-current control type of power supply and applies a positive charge opposite in polarity to the regular or negative charge of toner to the sheet 100. In the illustrative embodiment, the power supply 65*a* is controlled such that a current to flow to the roller 61 is, e.g., +15 μA. When the bias is applied from the power supply 65*a* to the adhesion roller 65, the sheet 100 moved away from the rollers 65 and 61 is electrostatically adhered to the belt 60.

The other power supply 65*b* is a constant-voltage control type of power supply. The power supply 65*b* is configured to increase the negative charge of toner deposited on the belt 60, invert the polarity of positively charged toner to negative, and transfer the toner of negative polarity deposited on the adhesion roller 65 to the belt 60 to thereby clean the roller 65. In the illustrative embodiment, a constant voltage of, e.g., −2 kV is applied to the adhesion roller 65. A control unit, not shown, selectively drives the power supply 65*a* or 65*a*.

A bias cleaner or cleaning means 70 adjoins part of the belt 60 extending between the two drums 63 and 64 and removes toner deposited on the surface of the belt 60. The bias cleaner 70 includes a conductive cleaning roller 71 facing the belt 60 and a bias power supply or cleaning bias applying means 75. The bias power supply 75 applies a bias between the cleaning roller 71 and the belt 60 for causing toner of negative polarity to move from the belt 60 to the cleaning roller 71, thereby forming an electric filed for cleaning. The bias cleaner 70 additionally includes a blade 72 for removing the toner deposited on the cleaning roller 71. The blade 72 contacts the cleaning roller 71 over a width slightly greater than an image range in the axial direction of the cleaning roller 71. A back roller 73 faces the cleaning roller 71 via the belt 60 and is constantly biased by a spring 74.

Hereinafter will be described control over the moving speed of the belt 60 unique to the illustrative embodiment. While the following description will concentrate on speed control, the illustrative embodiment is similarly applicable to control over the position of the belt 60.

Figure 4:
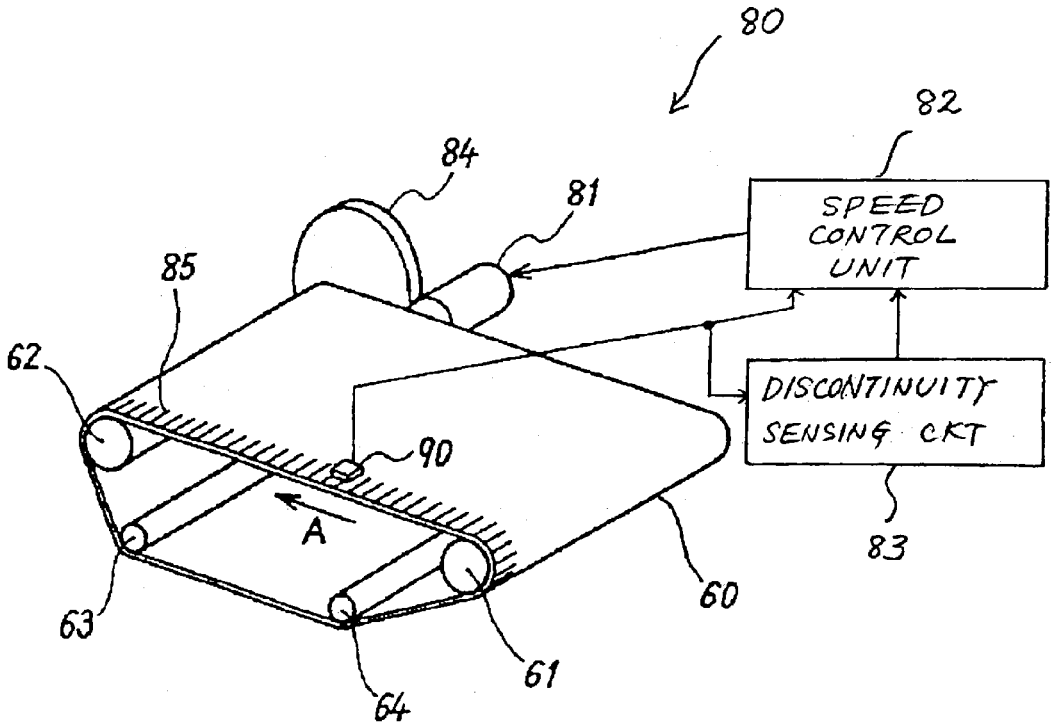
FIG. 4 shows a specific configuration of a device included in the illustrative embodiment for driving a belt that conveys a sheet.

FIG. 4 shows a driving device for driving the belt 60 specifically. As shown, the driving device, generally 80, includes a belt motor or drive transmitting means 81, a speed control unit or speed/position control means 82, and a discontinuity sensing circuit 83. The belt motor 81 causes the drive roller 62 to rotate. The speed control unit 82, discontinuity sensing circuit 83 and a mark sensor 90, which will be described later, constitute a drive control section or drive control means.

In the illustrative embodiment, the belt motor 81 is implemented as a stepping motor. The output torque of the belt motor 81 is transferred to the drive roller 62 via a speed reducer 84 mounted on the same shaft as the drive roller 62. The drive roller 62 in rotation causes the belt 60 to turn in the direction A by friction.

A plurality of marks 85 are formed on one edge portion of the belt 60 at preselected intervals in the direction A. The mark sensor or mark sensing means 90 is so positioned as to face the marks 85 that move in the direction A in accordance with the movement of the belt 60. On detecting each mark 85, the mark sensor 90 sends a mark sense signal to the speed control unit 82 and discontinuity sensing circuit 83.

Figure 5:
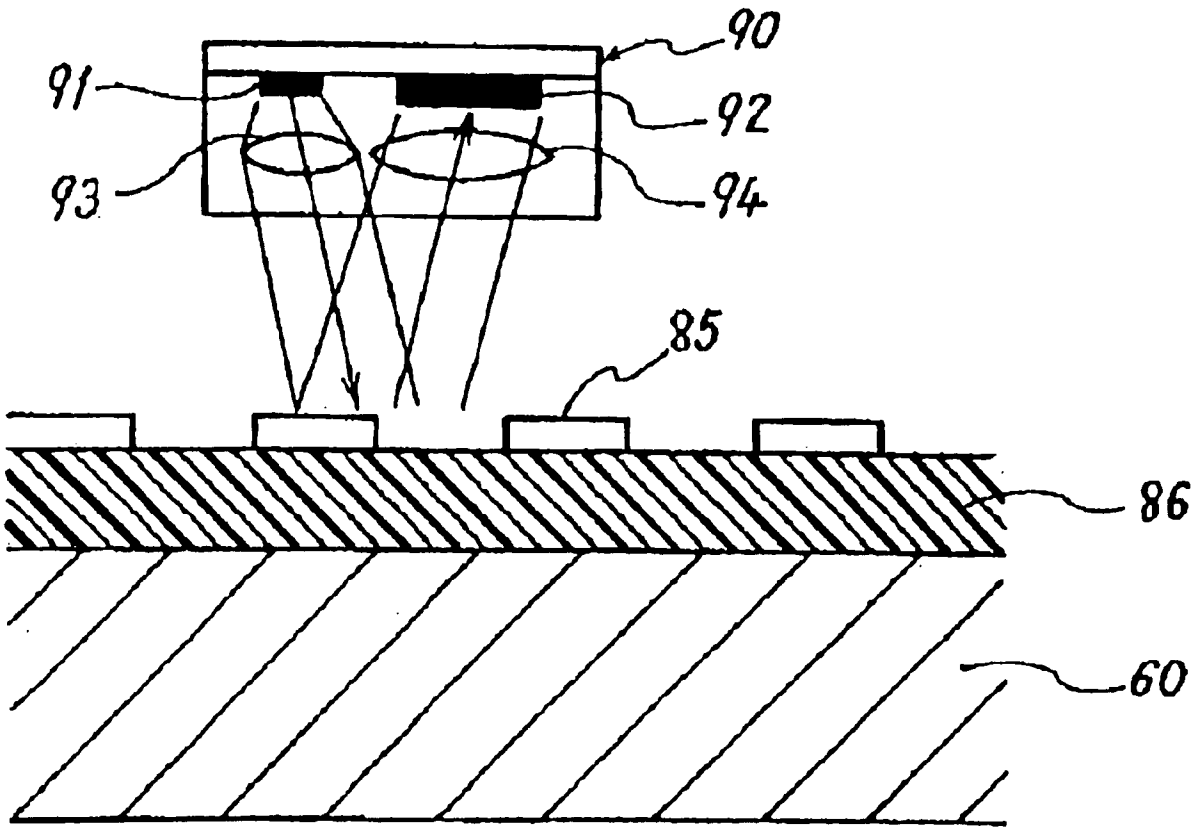
FIG. 5 is an enlarged view showing a specific configuration of a mark sensor included in the illustrative embodiment.

FIG. 5 shows a specific configuration of the mark sensor 90. In the illustrative embodiment, the mark sensor 90 is implemented as a reflection type photosensor. As shown, the mark sensor 90 is basically made up of a light source, which is implemented as an LED (Light Emitting Diode), 91 and a photodetector 92. Light issuing from the light source 91 is focused by a lens 93 on a position where the marks 85 of the belt 60 pass. The resulting reflection from any one of the marks 85 is focused by a lens 94 on the photodetector 92. In response, the photodetector outputs a pulse signal as a mark sense signal. Of course, the reflection type photosensor may be replaced with any other suitable mark sensing means so long as it can sense the marks 85. For example, when the marks 85 are implemented as a magnetic pattern, a magnetic head may be used as mark sensing means. Also, when the marks 85 are implemented as a linear scale for an encoder, an encoder head may be used as mark sensing means.

Figure 6:
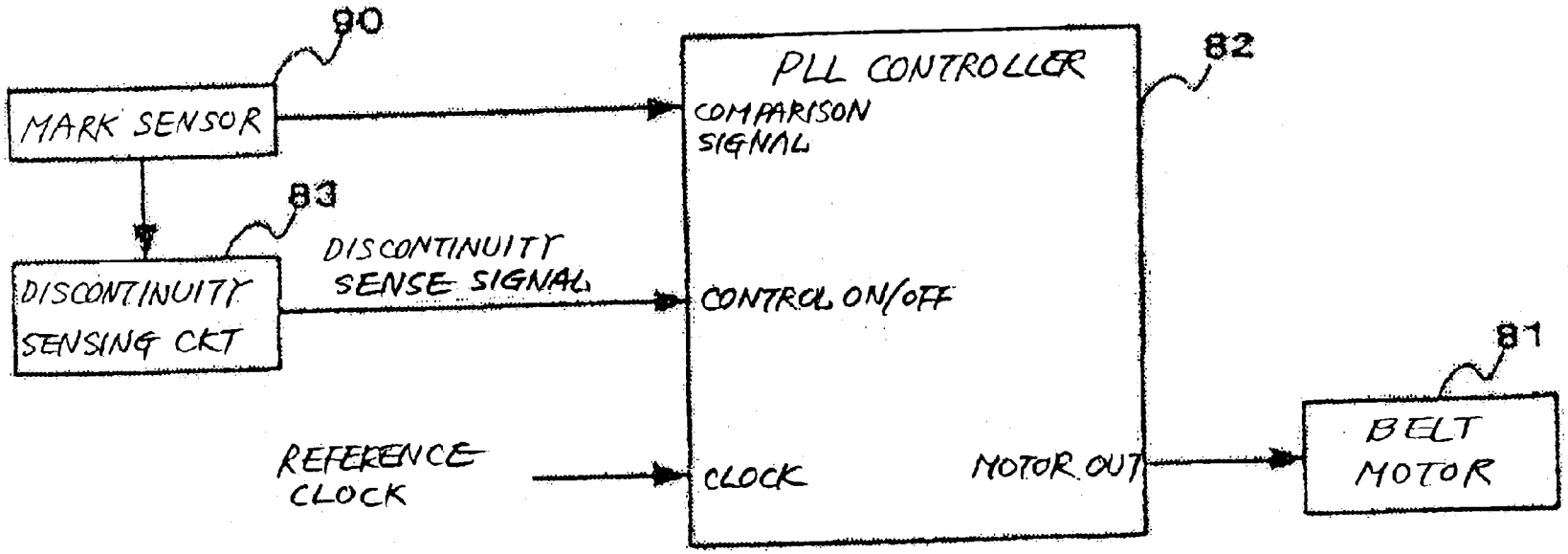
FIG. 6 is a schematic block diagram showing a speed control unit included in the belt driving device.

FIG. 6 shows a specific configuration of the speed control unit 82. As shown, the speed control unit 82 is implemented as a PLL controller including a PLL circuit. The speed control unit 82 includes a clock terminal to which a reference clock or reference signal is input, and a comparison signal terminal to which the mark sense signal or comparison signal is input. The speed control unit 82 compares the phase of the mark sense signal and that of the reference clock and sends a drive signal to the belt motor 81 via a motor output (OUT) terminal for matching the two phases. The speed control unit 82 additionally includes a control ON/OFF terminal to which a discontinuity sense signal output from the discontinuity sensing circuit 83. The PLL operation of the PLL controller 82 is interrupted when the discontinuity sense signal is input via the ON/OFF terminal.

To interrupt the PLL operation, when the discontinuity sense signal is input to the control ON/OFF terminal, the mark sense signal input to the comparison signal terminal may be replaced with the reference clock, in which case the feedback control from the mark sensor 90 will not be executed. Further, because the reference signal and reference clock are of the same phase, a drive signal derived from such a phase is sent to the drive motor 81 via the motor output terminal.

In the illustrative embodiment, the distance between nearby marks 85 should preferably be substantially equal to the resolution of an image in the subscanning direction perpendicular to the main scanning direction or substantially equal to an integral ratio thereof. When the optical writing unit 2 is a polygonal scanner, a synchronizing signal meant for a polygonal mirror may be used as the reference signal to be input to the speed control unit 82. In such a case, every time the polygonal mirror scans a single line, the mark sensor 90 outputs a single pulse as a mark sense signal and allows an error in the image position on a sheet to be extremely small. This speed control synchronous to the period of exposure insures accurate positioning of an image on a sheet.

Figure 7:
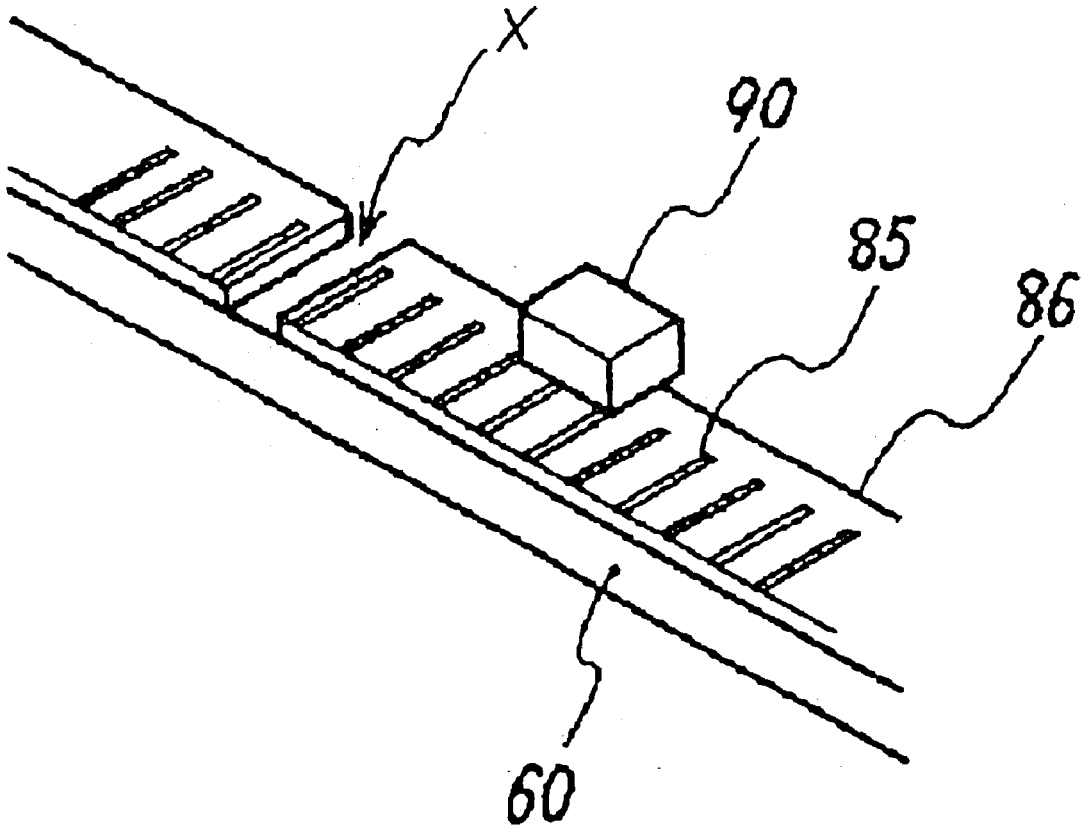
FIG. 7 is an enlarged view showing part of the belt where marks are positioned.

FIG. 7 shows part of the belt 60 where the marks 85 are positioned. In the illustrative embodiment, because the mark sensor 90 is a reflection type photosensor, the marks 85 are implemented as an optical reflection pattern while the belt 60 is provided with a black surface. As shown in FIG. 7, a resin tape or flexible member 86 on which the marks 85 are formed is adhered to one edge portion of the belt 60 parallel to the direction of movement of the belt 60. Although the marks 85 may be molded together with the belt 60, molding prevents the distance between nearby marks from remaining constant when the contraction ratio of the entire belt 60 is not constant, as stated previously.

A problem with the resin tape 86 having the marks 85 is that circumferential length is different between belts 60 due to tolerance particular to a production line. As a result, as shown in FIG. 7, a seam portion between opposite ends of the resin tape 86 differs in width from one belt 60 to another belt 60. The mark distance in the seam portion is usually made greater than in the continuous portion, so that a discontinuous portion X different in mark distance from the continuous portion exists in the nip portion. Consequently, although the pulse interval of the mark sense signal remains substantially the same when the mark sensor 90 is sensing the continuous portion, the period of pulses noticeably varies when the mark sensor 90 is sensing the discontinuous portion X. Moreover, the variation of the pulse period exceeds an allowable error range.

Figure 8:
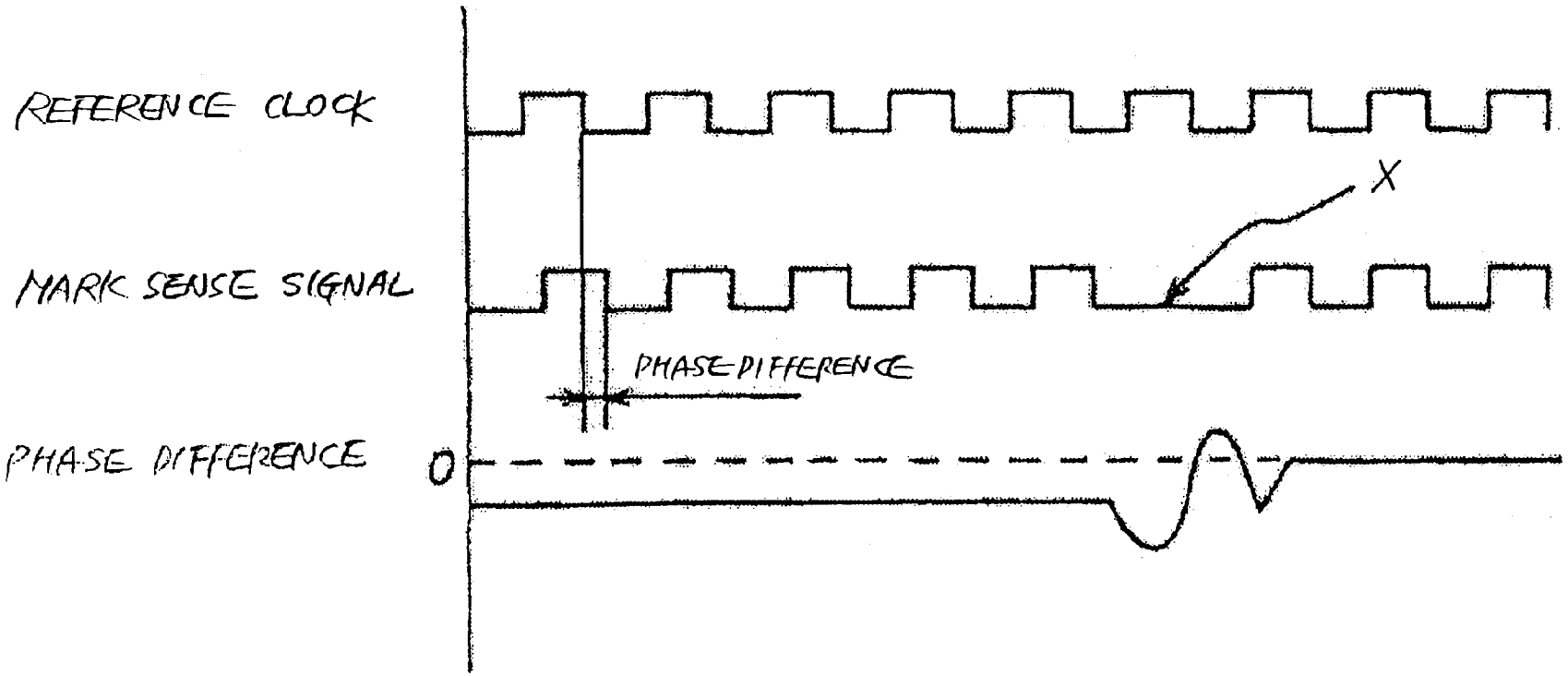
FIG. 8 is a timing chart showing a reference clock and a mark sense signal input to the speed control device and a phase difference determined by a PLL controller specifically.

FIG. 8 is a timing chart showing the reference clock and mark sense signal input to the speed control unit 82 and a phase difference determined in the PLL controller specifically. As shown, the pulse period noticeably varies in the discontinuous portion X with the result that the seam portion of the sense mark signal corresponding to the portion X noticeably differs in phase from the reference clock. As a result, the operation of the speed control unit 82, which performs PLL control with the mark sense signal or comparison signal, becomes unstable and fails to stably control the drive of the belt 60. In light of this, in the illustrative embodiment, the discontinuity sensing circuit 83 senses the discontinuous portion X, so that the speed of the belt 60 can be controlled in accordance with the output of the circuit 83.

Figure 9:
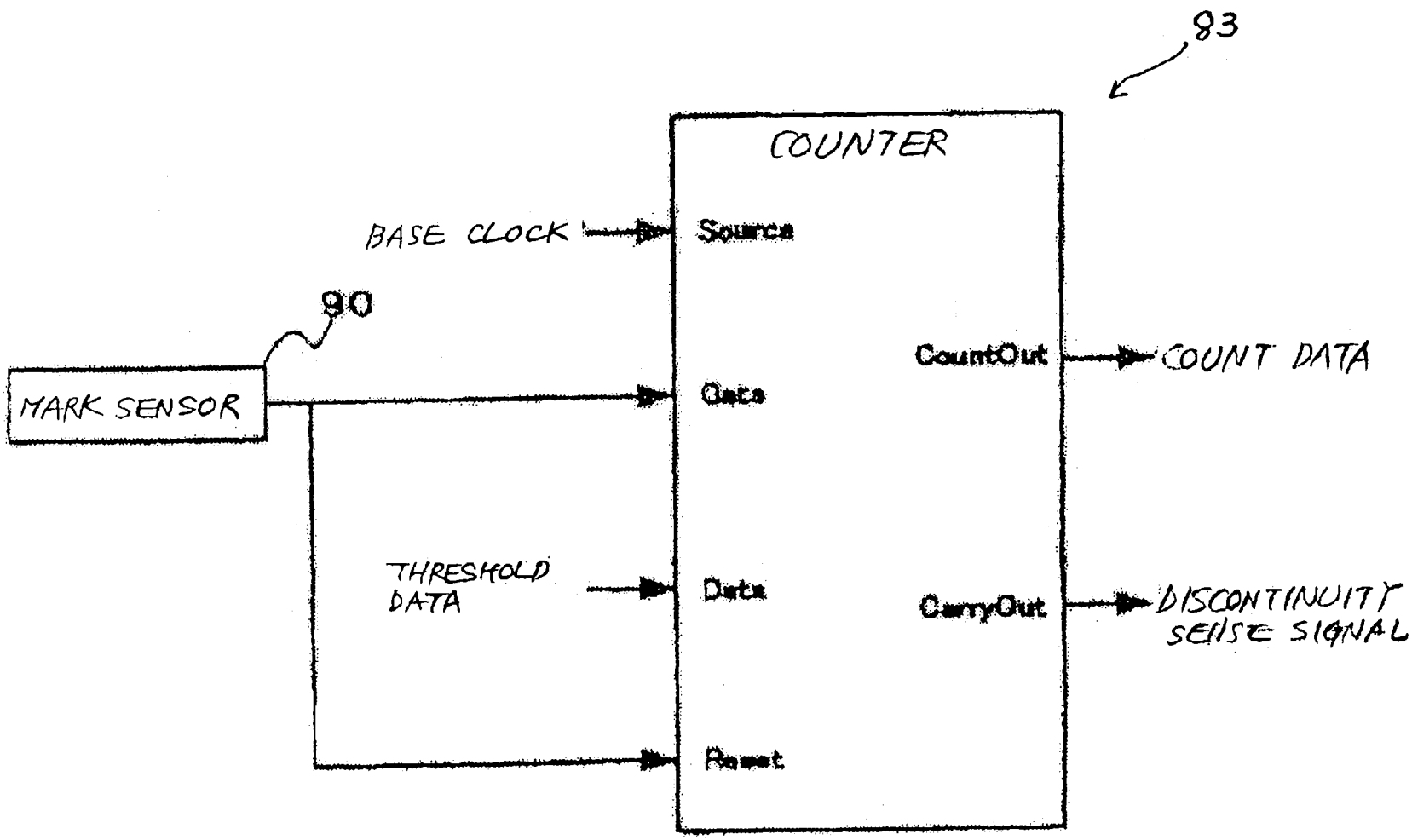
FIG. 9 is a schematic block diagram showing a discontinuity sensing circuit included in the belt driving device.
Figure 10:
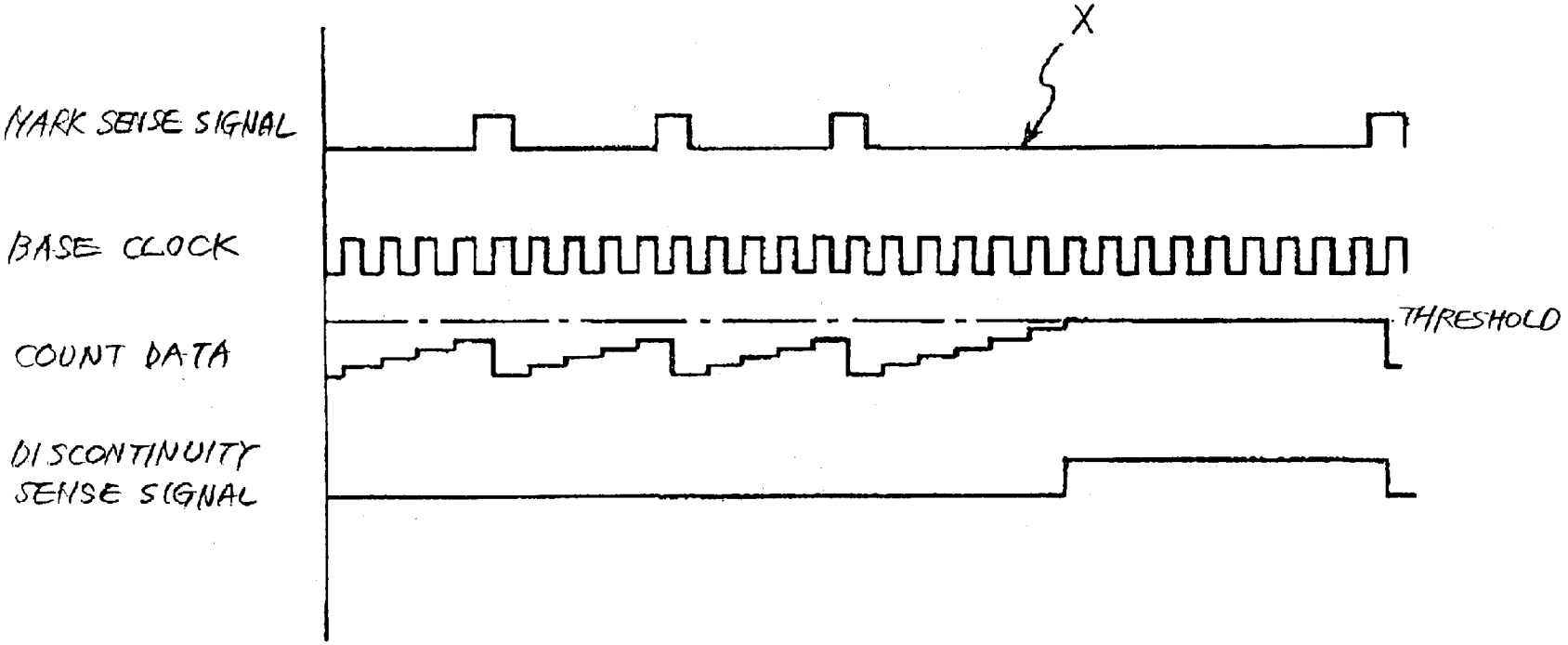
FIG. 10 is a timing chart showing signals input to the discontinuity sensing circuit and an output signal of the circuit specifically.

FIG. 9 shows a specific configuration of the discontinuity sensing circuit 83. FIG. 10 shows specific signals input to the circuit 83 and a specific signal output from the circuit 83. As shown in FIG. 9, the circuit 83 is implemented as a conventional counter circuit including a source terminal to which a base clock is input and a gate and a reset terminal to which the mark sense signal is input. The base clock is a repeating pulse signal whose period is far shorter than the pulse period of the mark sense signal. The circuit 83 increments count data every time the base clock is input. The count data is reset at the positive-going edge of the base clock input for the first time when the mark sense signal is being input to the gate terminal. Preselected threshold data is input to a data terminal also included in the circuit 83. The threshold data is selected to be slightly greater than the maximum value of the count data corresponding to the continuous portion of the marks 85.

The discontinuous portion X included in the marks 85 has a width greater than the distance between nearby marks 85, as stated earlier. Therefore, the count data derived from the discontinuous portion X is far greater than the count data derived from the continuous portion. Consequently, if the mark sense signal is not input to the counter circuit 83 at the expected timing due to the arrival of the discontinuous portion X at the mark sensor 90, then the count data reaches a threshold value represented by the threshold data. In response, the counter circuit 83 outputs a discontinuity sense signal via its carry out terminal. The discontinuity sense signal is input to the control ON/OFF terminal of the speed control unit 82, as stated previously. On the other hand, when the mark sense signal is input to the reset terminal for the first time after the count data has exceeded the threshold value, the discontinuity sense signal disappears at the positive-going edge of the above mark sense signal. The count data is reset at the positive-going edge of the base clock input for the first time when the mark sense signal is being input to the gate terminal.

The discontinuity sense signal input to the control ON/OFF terminal indicates the speed control unit 82 that the discontinuous portion X is present in the sensing region of the mark sensor 90. While the discontinuity sense signal is input, the speed control unit 82 does not perform the PLL operation, but sends the drive signal to the belt motor 81, as stated earlier. In this manner, the speed control unit 82 does not use the mark sense signal derived from the discontinuous portion X and making the PLL operation unstable and can therefore stably control the drive of the belt 60.

While the speed control unit 82 is shown and described as using a PLL controller, any other arrangement may be used so long as it can control the ON/OFF of the control operation in accordance with an external signal. For example, use may be made of a speed control device including a signal processing section configured to execute processing based on a program in accordance with the comparison signal and send an adequate drive signal to the drive motor 81. More specifically, the processing section may calculate the speed of the belt 60 by using the comparison signal and then generates a drive signal necessary for driving the belt 60 at a target speed. This configuration can adapt to the change of signal processing more flexibly than a logical circuit implemented by hardware.

Specific modifications of the drive control section included in the illustrative embodiment will be described hereinafter.

[Modification 1]

Figure 11:
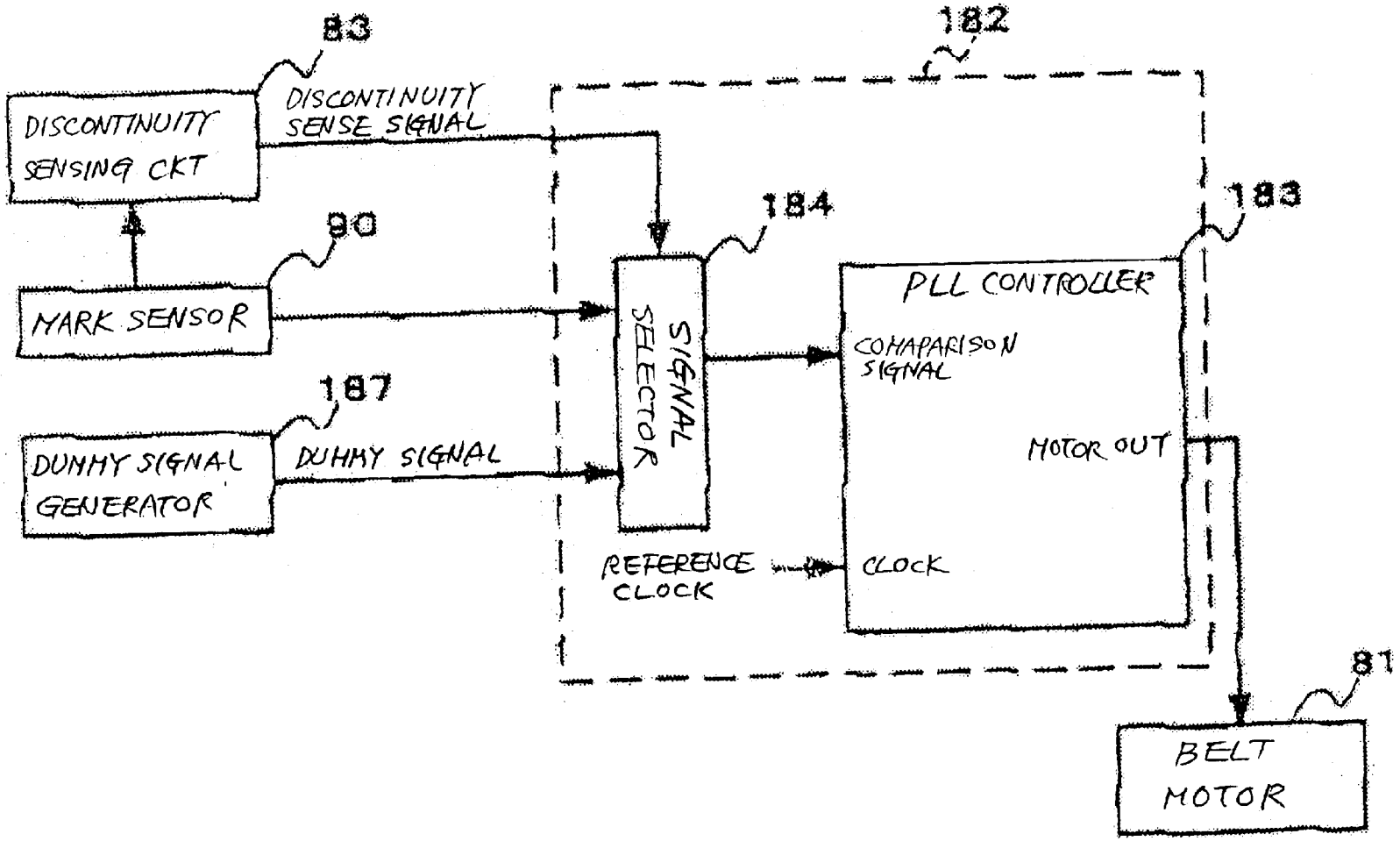
FIG. 11 is a schematic block diagram showing Modification 1 of the illustrative embodiment.

FIG. 11 shows Modification 1 of the illustrative embodiment. As shown, the drive control section includes a dummy signal generator or generating means 187 and a speed control unit or speed/position control means 182 in addition to the mark sensor 90 and discontinuity sensing circuit 83. The speed control unit 182 includes a PLL controller 183 similar to that of the illustrative embodiment and a signal selector or signal switching means 184. In Modification 1, the PLL controller 183 does not have to be ON/OFF controlled by an external signal and is therefore low cost.

The dummy signal generator 187 generates a dummy signal repeatedly appearing at a period identical with the mean interval of the mark sense signals derived from the continuous mark portion. More specifically, the dummy signal generator 187 samples a plurality of mark sense signals derived from the continuous mark portion, calculates a mean value over the sampling interval, and generates a dummy signal repeatedly appearing with a period having the calculated mean value. The dummy signal generator 187 may comprise the combination of a frequency counter, a memory, an arithmetic circuit, and a pulse oscillator.

The belt 60, which is the subject of control, moves at a constant speed. Therefore, if a pulse oscillator configured to output repeating pulses having the same period as the mark sense signals is prepared beforehand, then dummy signals are obtainable without resorting to sampling or mean value calculation. This simplifies the configuration of the dummy signal generator 187.

The signal selector 184 distinguishes the mark sense signal from the mark sensor 90 and the dummy signal from the dummy signal generator 187 and delivers the signal selected to the PLL controller 183. For this purpose, the signal selector 184 uses the discontinuity sense signal output from the discontinuity sensor 83. More specifically, the signal selector 184 selects the mark sense signal when the discontinuity sense signal is in an OFF state or selects the dummy signal when it is in an ON state.

Figure 12:
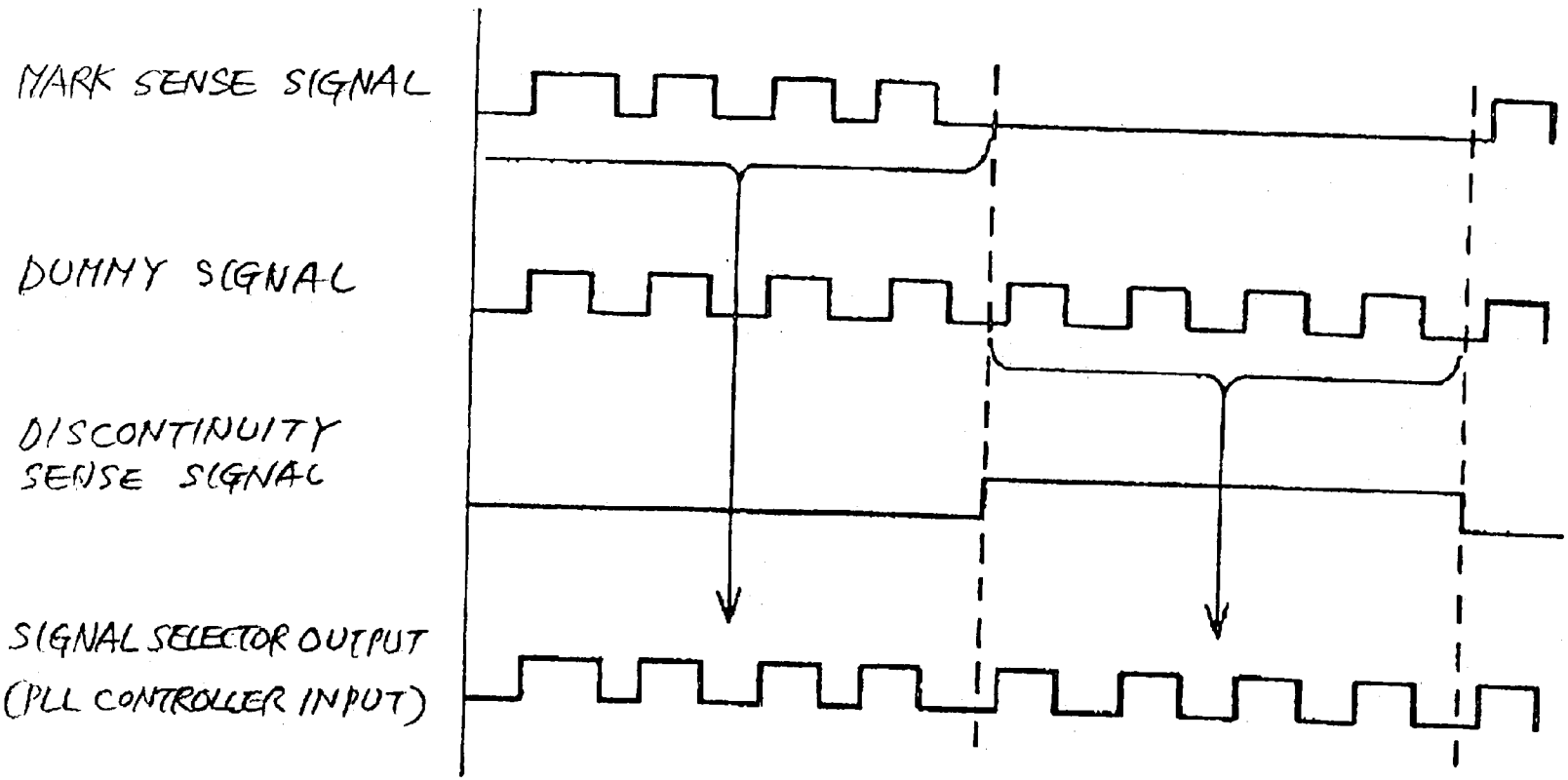
FIG. 12 is a timing chart showing signals input to a signal selector included in Modification 1 and an output signal of the same specifically.

FIG. 12 shows specific waveforms of the signals input to the signal selector 184 and a signal output from the same. As shown, when the discontinuity sense signal is in an OFF state, the signal selector 184 outputs the mark sense signal. When the discontinuity sensing circuit 83 outputs the discontinuity sense signal as in the illustrative embodiment, the signal selector 184 switches its output from the mark sense signal to the dummy signal. While the discontinuity sense signal is in an ON state, the signal selector 184 outputs the dummy signal instead of the mark sense signal. Subsequently, when the discontinuity sense signal again goes low, the signal selector 184 outputs the mark sense signal received from the mark sensor 90. Consequently, the signal selector 184 outputs a repeating pulse signal continuously. The PLL controller 183 therefore receives the pulse signal whose period varies little as a comparison signal, stably controlling the drive of the belt 60.

[Modification 2]

Modification 2 will be described with reference to FIG. 13. In Modification 1 described above, the phase of the mark sense signal and that of the dummy signal are not matched to each other. This brings about a problem that if the two phases are shifted from each other, then the phase of the repeating pulse signal input to the PLL controller 183 is apt to jump for a moment in relation to the signal switching timing of the signal selector 184, causing the above phase to be noticeably shifted from the phase of the reference clock. Modification 2 is so configured as to reduce the jump of the phase of the repeating pulse signal input to the PLL controller 183, as will be described hereinafter.

Figure 13:
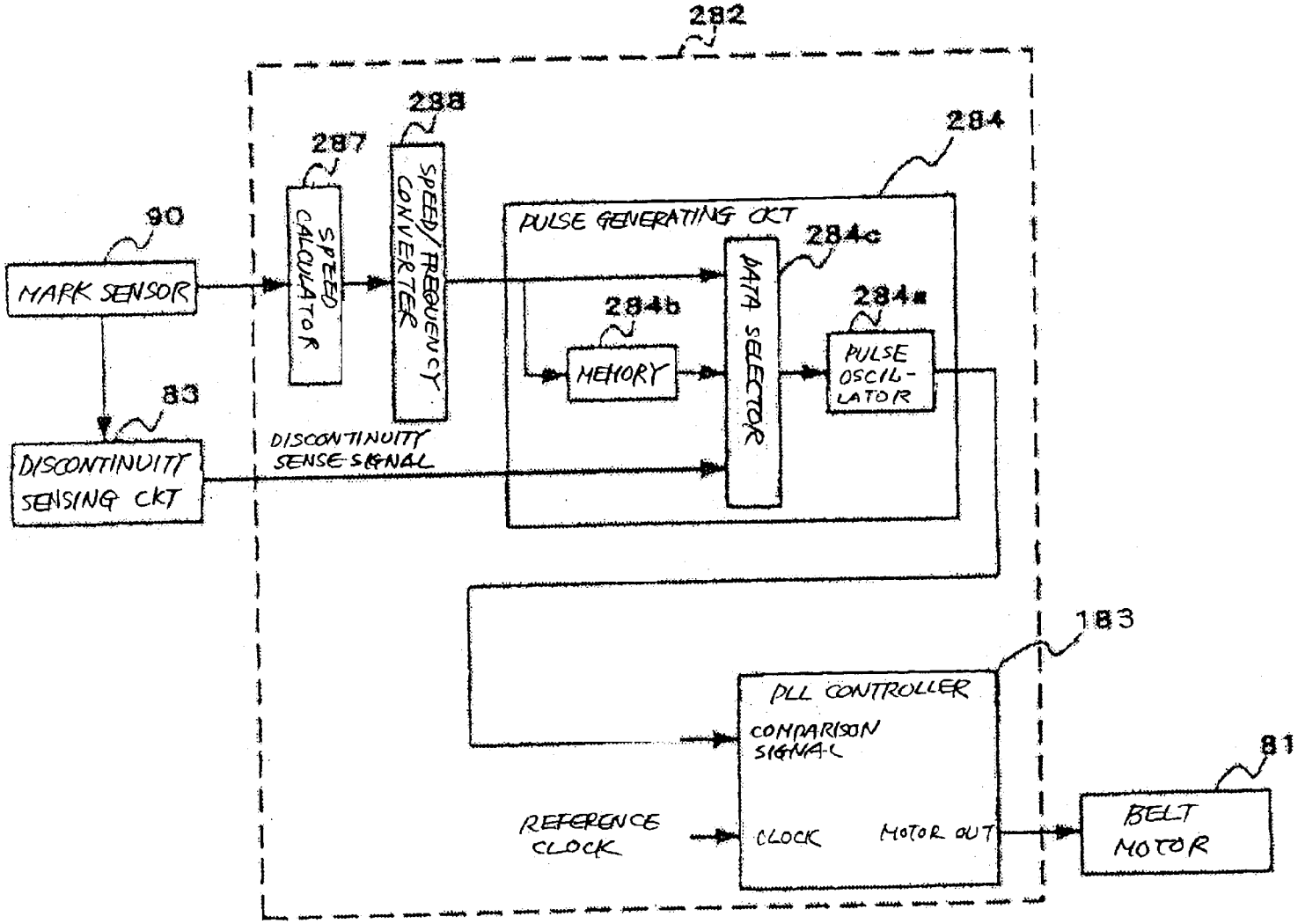
FIGS. 13 and 14 are schematic block diagrams respectively showing Modifications 2 and 3 of the illustrative embodiment.

As shown in FIG. 13, the drive control section includes a speed control unit or speed/position control means 282 in addition to the mark sensor 90 and discontinuity sensing circuit 83. The speed control unit 282 includes a speed calculator 287, a speed/frequency converter 288 and a pulse signal generating circuit or frequency signal generating means 284 in addition to the PLL controller 183 identical with one included in Modification 1.

The speed calculator 287 calculates the moving speed of the belt 60 on the basis of the mark sense signal derived from the continuous mark portion and delivers the calculated speed to the speed/frequency converter 288. The speed calculator 287 may be implemented by a counter circuit configured to count the pulse intervals of the mark sense signal output from the mark sensor 90 by using a clock. In this case, the clock is provided with frequency higher than the pulse frequency of the mark sense signal, so that the counter circuit counts, by using the positive-going edge of a mark sense signal as a gate signal, pulses of the clock up to the positive-going edge of the next mark sense signal. The resulting count data is latched at the positive-going edge of the next pulse, recorded in an output register, and then reset. The count signal thus stored in the output register is representative of a pulse width, i.e., the interval between the mark sense pulses. Therefore, the speed of the belt 60 can be determined on the basis of the count data and the mark distance on the belt 60.

The speed/frequency converter 288 converts the speed data output from the speed calculator 287 to frequency, or the content of the output of the mark sensor 90, which the speed control unit 282 uses. At this instant, a conversion coefficient is determined in accordance with frequency necessary for the speed control unit 282.

If the frequency necessary for the speed control unit 282 is identical with the pulse frequency of the mark sense signal, then the speed calculator 287 outputs data representative of the pulse width of the mark sense signal. In this case, the speed/frequency converter 288 calculates a reciprocal of the pulse width and feeds the reciprocal to the speed control unit 282 as frequency data.

In the pulse signal generating circuit 284, a pulse oscillator 284*a* generates a repeating pulse signal having a frequency indicated by the frequency data, which is input from the speed/frequency converter 288. The pulse signal generated by the pulse oscillator 284*a* is sent to the PLL controller 183 as a comparison signal. A memory 284*b* and a data selector 284*c* are also included in the pulse signal generating circuit 284. Among frequency data received from the speed-to-frequency converter 288, only the data derived from the continuous mark portion are written to the memory 284*a*. The data selector 284*c* distinguishes the frequency data output from the speed/frequency converter 288 and the frequency data read out of the memory 284*b* and delivers the frequency data selected to the pulse oscillator 284*a*. To select either one of the two kinds of frequency data, the discontinuity sense signal output from the discontinuity sensing circuit 83 is used. More specifically, the data selector 284*c* selects the frequency data output from the speed/frequency converter when the discontinuity sense signal is in an OFF state or selects the frequency data read out of the memory 284*b* when it is in an ON state.

As stated above, Modification 2 switches the frequency data, which determines the frequency of the pulse signal output from the pulse oscillator 284*a*, by using the discontinuity sense signal output from the discontinuity sensing circuit 83. Stated another way, Modification 2 does not directly switch the comparison signal input to the PLL controller 183. Further, when the discontinuous portion is sensed, the data selector 284*c* reads the frequency data derived from the continuous mark portion out of the memory 284*b* and feeds it to the pulse oscillator 284*a*. Therefore, the frequency data input to the pulse oscillator 284*a* is free from noticeable errors. This allows the pulse oscillator 284*a* to send a repeating pulse signal having a stable frequency continuously to the PLL controller 284*a* without interruption.

Modification 2 can therefore reduce the phase jump of the repeating pulse signal input to the PLL controller 183 for thereby promoting more stable drive control.

[Modification 3]

Figure 14:
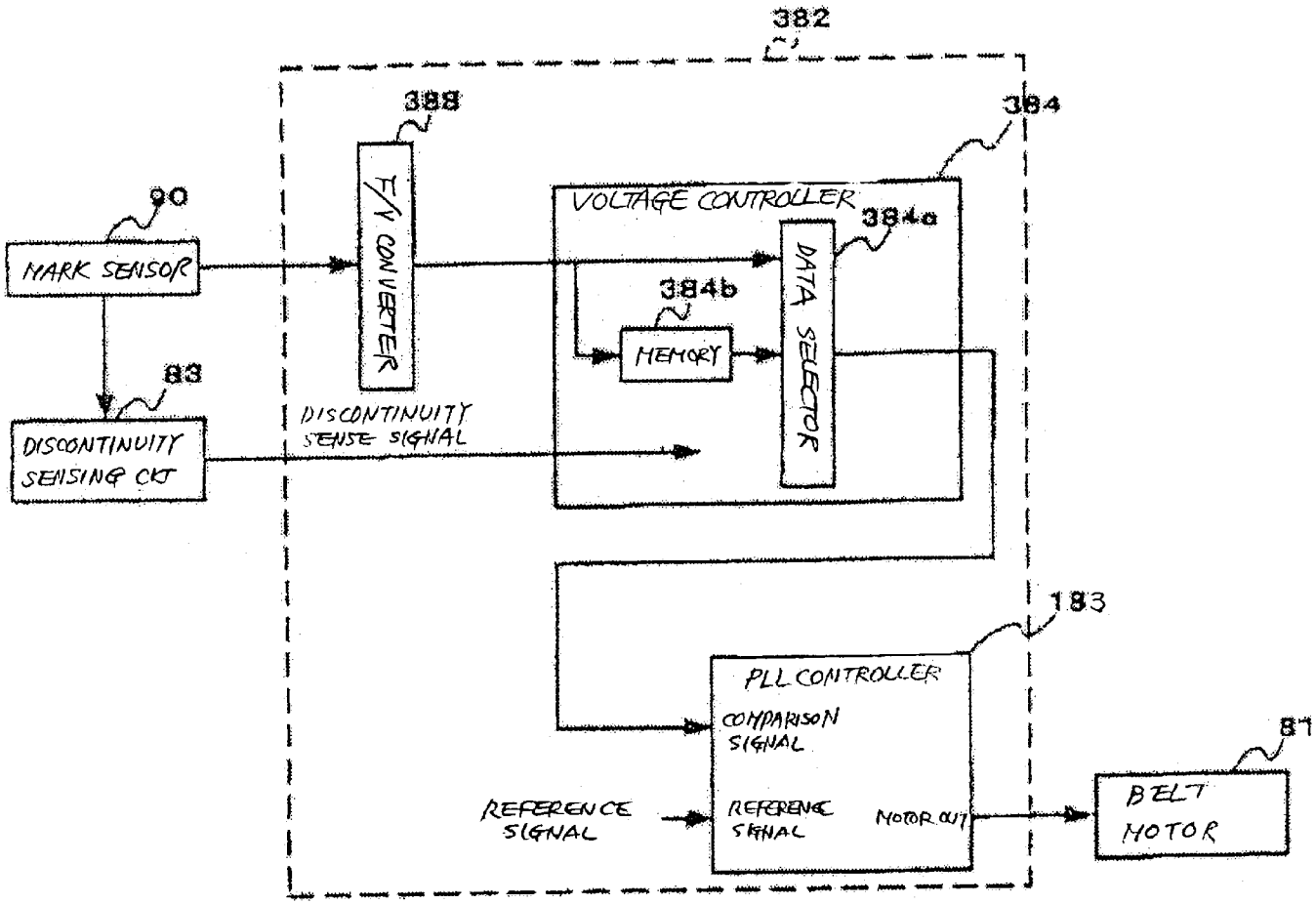

Reference will be made to FIG. 14 for describing Modification 3 of the illustrative embodiment. As shown, a drive control section includes a speed control unit or speed/position control means 382 in addition to the mark sensor 90 and discontinuity sensing circuit 83. The speed control unit 382 includes a PPL controller 183, an F/V (frequency-to-voltage) converter 388, and a voltage control circuit 384. The controller 383 sends to the belt motor 81 a drive signal corresponding to the feedback signal derived from the mark sensor 90.

More specifically, the controller 383 includes a reference signal terminal to which a reference voltage or reference signal is input and a comparison signal terminal to which a voltage signal output from the voltage control circuit 384 is input. The reference voltage is matched to the target moving speed of the belt 60. The controller 383 compares the reference voltage and the voltage signal output from the voltage control circuit 384 and sends a drive signal, which equalizes the two voltages, to the belt motor 81 via a motor output (OUT) terminal.

The F/V converter 388, which may have a conventional configuration, receives the mark sense signal or repeating pulse signal from the mark sensor 90 and converts it to a voltage signal with a preselected conversion coefficient k. The voltage signal is input to the voltage control circuit 384. Because the voltage signal is based on the pulse interval of the mark sense signal output from the mark sensor 90, the conversion coefficient k may be used to produce speed data m/s by using an equation:

$$m/s = P(m) \times E(V)/k(V/Hz)$$

where E denotes the output of the F/V converter 388, and P denotes the mark distance on the belt 60.

The voltage control circuit 384 is made up of a memory or memory means 384*b* and a signal selector 384*c* identical in function with the signal selector 184 of Modification 1. The voltage signal input from the F/V converter 388 is written to the memory 384*b* for a preselected period of time and then readout of the memory 384*b*. The preselected period of time mentioned above is selected to be longer than a period of time necessary for the discontinuous portion moves away from the sensing region of the mark sensor 90. For the memory 384*b*, use may be made of a conventional delay circuit. The signal selector 384*c* selects either one of the voltage signal output from the F/V converter 388 and the voltage signal read out of the memory 384*c* and sends the voltage signal selected to the controller 383. For the selection, the discontinuity sense signal output from the discontinuity sensing circuit 83 is used. More specifically, the signal selector 384*c* selects the voltage signal output from the F/V converter 388 when the discontinuity sense signal is in an OFF state or selects the voltage signal read out of the memory 384*b* when it is in an ON state.

While Modification 3 directly switches the signal to be input to the controller 383 by using the discontinuity sense signal, the above signal is a voltage signal. In the case where the repeating pulse signal or similar frequency signal is input to the PLL controller 182 as a comparison signal, to select either one of the signal for speed control in the discontinuous portion X and the speed control in the continuous portion, it is necessary that signals before and after switching be substantially identical as to two parameters, i.e., frequency and phase. By contrast, in Modification 3 using only the voltage signal, signals before and after switching should only be identical as to a single diameter, i.e., voltage. This simplifies the setting of, e.g., the signal for speed control in the discontinuous portion, compared to the case wherein frequency is used.

[Modification 4]

Figure 15:
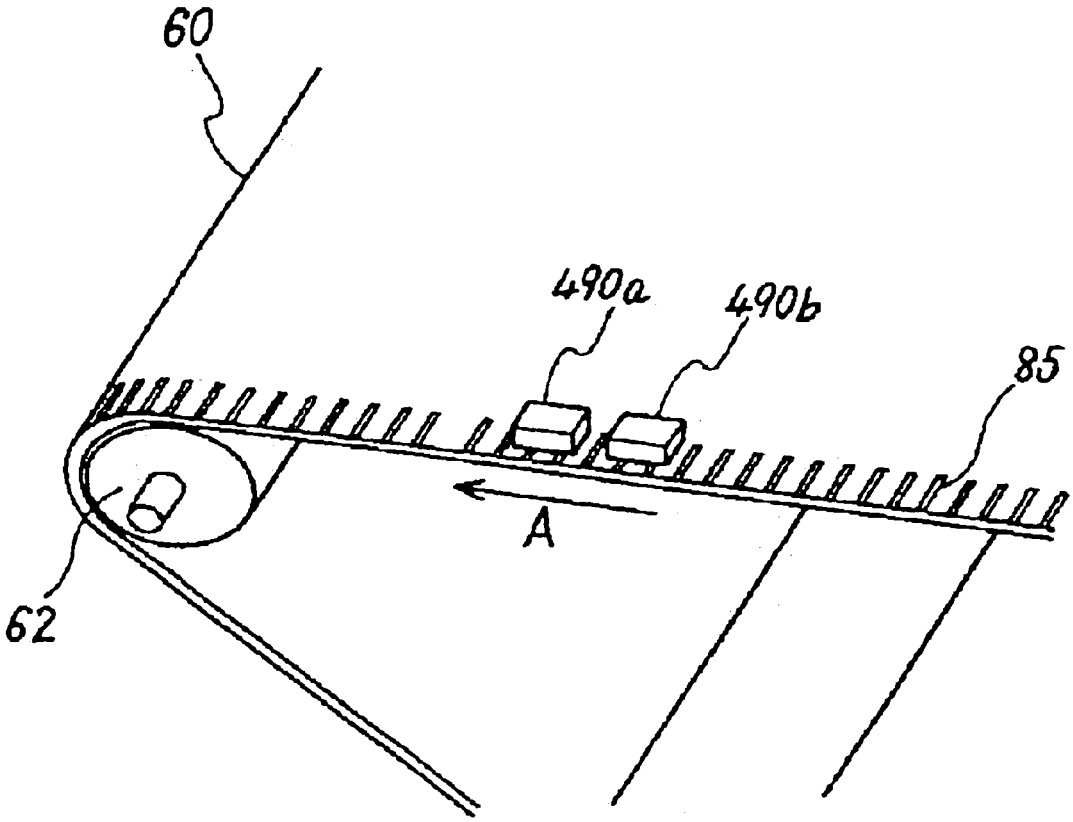
FIG. 15 shows the arrangement of two marks sensors included in Modification 4 of the illustrative embodiment.

Modification 4 of the illustrative embodiment will be described with reference to FIG. 15. As shown, Modification 4 uses two mark sensors 490*a* and 490*b* although three or more mark sensors may be used. The distance between the mark sensors 490*a* and 490*b* should be as short as possible. However, the above distance should be longer than the length of the discontinuous portion in the direction of movement of the belt 60. Further, the mark sensors 490*a* and 490*b* should preferably be located such that the pulse phases of the mark sense signals output therefrom coincide with each other.

Figure 16:
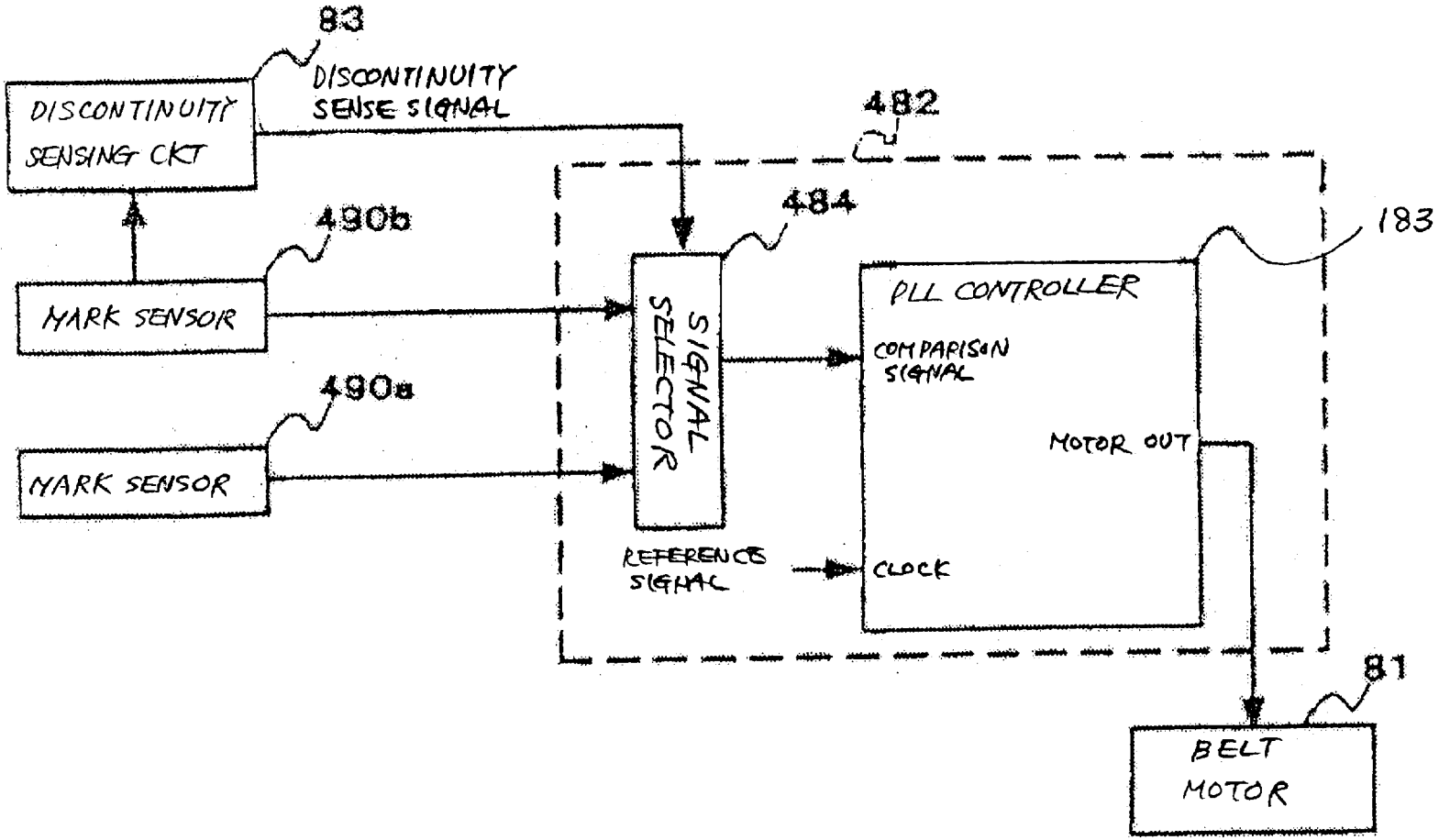
FIG. 16 is a schematic block diagram showing a drive control section included in Modification 4.

FIG. 16 shows a drive control section included in Modification 4. As shown, the drive control section includes a speed control unit or speed/position control means 482 in addition to the mark sensors 490*a* and 490*b* and discontinuity sensing circuit 83. The speed controller 482 includes a signal selector 484 as well as the PLL controller 183 identical with one included in Modification 1.

The signal selector 484 selects either one of mark sense signals output from the mark sensors 490*a* and 490*b* and delivers the signal selected to the PLL controller 183. For the selection, use is made of the discontinuity sense signal output from the discontinuity sensing circuit 83. The mark sense signal output from the mark sensor 490*b*, which is located at the upstream side in the direction A, is input to the discontinuity sensing circuit 83 as well. In this configuration, because the distance between the mark sensors 490*a* and 490*b* is greater than the length of the discontinuous portion X, as stated earlier, the discontinuous portion X can be sensed before it enters the sensing region of the downstream mark sensor 490*a*. The signal selector 484 selects the mark sense signal of the mark sensor 490*b* when the discontinuity sense signal is in an OFF state or selects the mark sense signal of the other mark sensor 490*a* when it is in an ON state.

Figure 17:
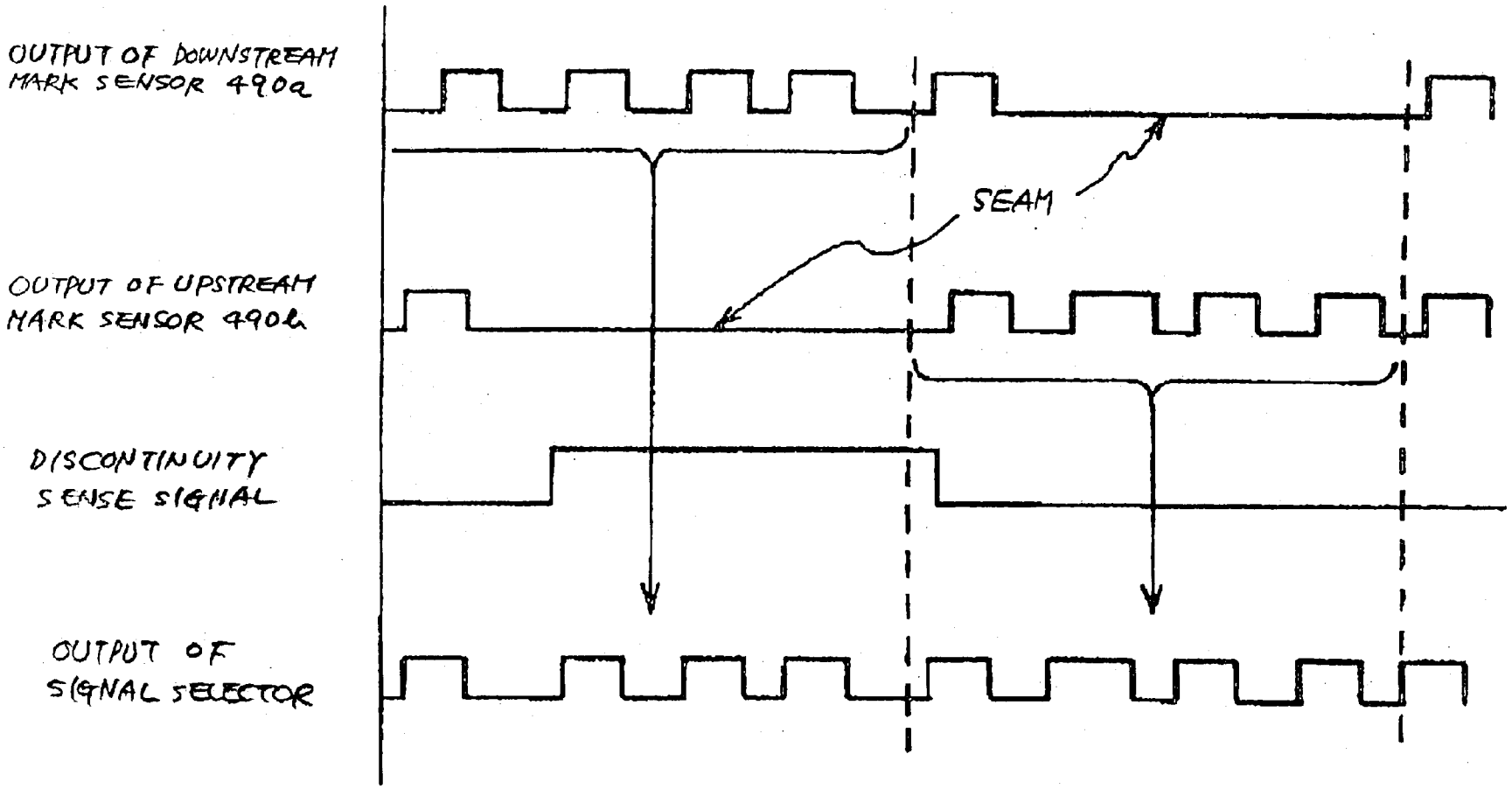
FIG. 17 shows signals input to a signal selector included in Modification 4 and an output signal of the same.

FIG. 17 shows specific waveforms of signals input to the signal selector 484 and a specific waveform of a signal output from the same. As shown, when the discontinuity sense signal is in an OFF state, the signal selector 484 selects the mark sense signal output from the upstream mark sensor 490*b*. On receiving the discontinuity sense signal from the discontinuous mark sensor 83, the signal selector 484 selects the mark sense signal output from the downstream mark sensor 490*a*. While the discontinuity sense signal is in an ON state, the signal selector 484 continuously selects the mark sense signal of the downstream mark sensor 490*a*. Subsequently, when the discontinuity sense signal again goes low, the signal selector 484 again selects the mark sense signal of the upstream mark sensor 490*b*. Consequently, the signal selector 484 outputs a continuous, repeating pulse signal shown in FIG. 17, i.e., a pulse signal whose period varies little is input to the PLL controller 183 as a comparison signal. The PLL controller 183 can therefore stably control the drive of the belt 60.

Moreover, even in the discontinuous portion X, Modification 4 can feed back the real-time mark sense signal to the PLL controller 183, insuring accurate speed control over the entire circumference of the belt 60. This advantage is not achievable with Modifications 1 through 3.

[Modification 5]

Figure 18:
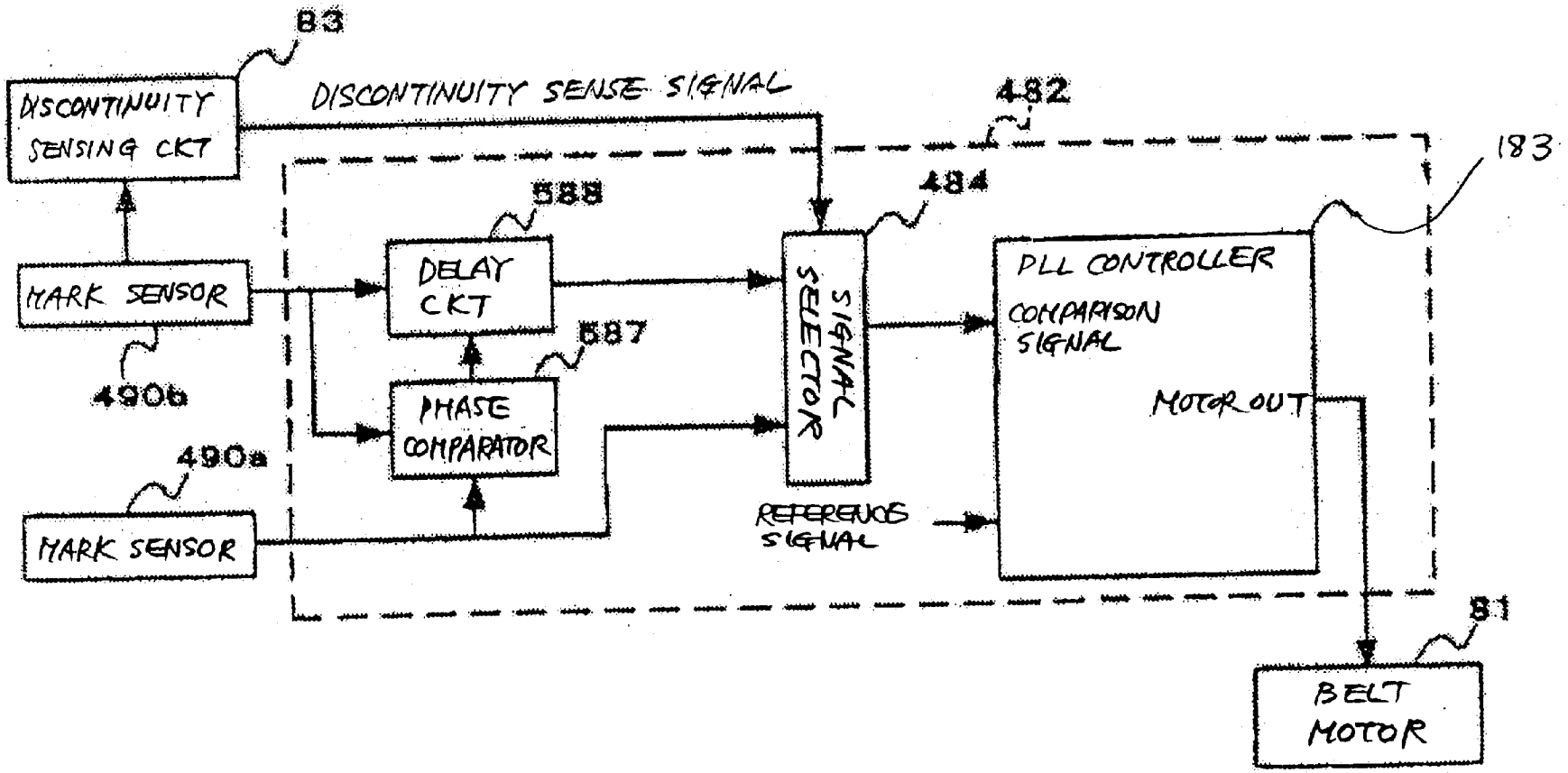
FIG. 18 is a schematic block diagram showing Modification 5 of the illustrative embodiment.

FIG. 18 shows a drive control section representative of Modification 5 that also includes two mark sensors 490*a* and 490*b*, but differs from Modification 4 in the following aspect. In Modification 4, the distance between the mark sensors 490*a* and 490*b* is so selected as to prevent the phases of the mark sense signals output from the mark sensors 490*a* and 490*b* from being shifted from each other. Such an arrangement, however, is difficult to practice when the pulse period of the mark sense signals is short. If the phases of the two mark sense signals are shifted from to each other, then the phase of the repeating pulse signal input to the PLL controller 183 is apt to jump, causing the phase of the comparison signal to be noticeably shifted from the phase of the reference clock. Modification 5 reduces the jump of the above repeating pulse signal with the following configuration.

As shown in FIG. 18, the drive control section includes a phase comparator or phase comparing means 587 and a delay circuit or phase correcting means 588 in addition to the structural elements of Modification 4. The mark sense signal output from the downstream mark sensor 490*a* is input to both of the signal selector 484 and phase comparator 587. The mark sense signal output from the upstream mark sensor 490*b* is input to both of the phase comparator 587 and delay circuit 588.

Figure 19:
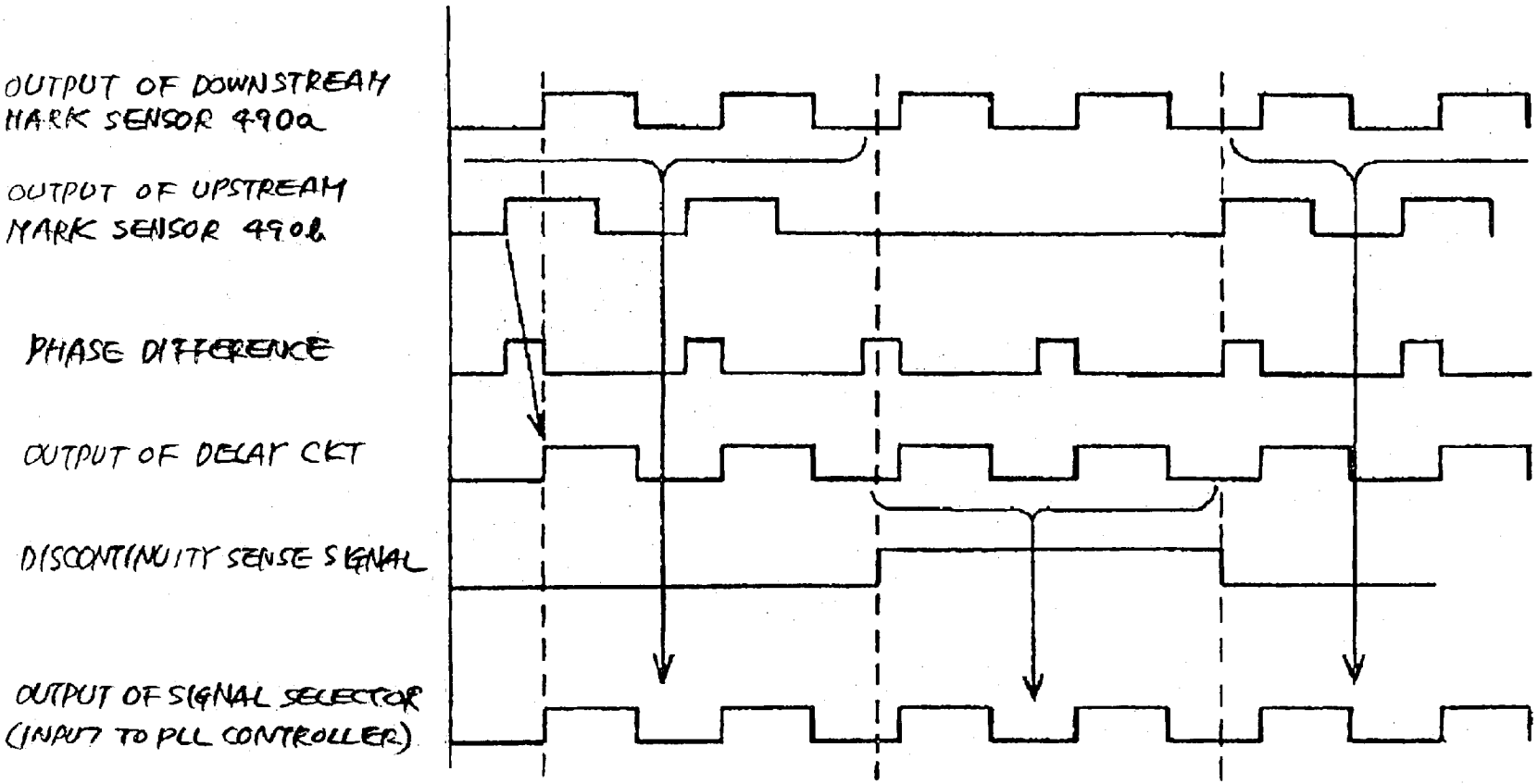
FIG. 19 shows specific waveforms of signals appearing in the circuitry of FIG. 18.

FIG. 19 shows specific signal waveforms appearing in various points of the circuitry of FIG. 18. As shown, when the distance between the two mark sensors 490*a* and 490*b* is not adjusted, the two mark sense signals are sometimes shifted in phase from each other. If such mark sense signals shifted in phase are directly input to the signal selector 484 as in Modification 4, then an error corresponding to the phase difference occurs in the speed control of the PLL controller 183 at the switching timing of the signal selector 484, obstructing accurate speed control. To obviate such an error, in Modification 5, after the mark sense signals of the mark sensors 490*a* and 490*b* have been input to the phase comparator 587, the resulting phase difference detected by the phase comparator 587 is input to the delay circuit 588. In response, the delay circuit 588 delays the phase of the mark sense signal of the downstream mark sensor 490*a* by the above phase difference and delivers the delayed signal to the signal selector 484. As a result, as shown in FIG. 19, the phases of the two mark sense signals are matched to each other.

The signal selector 484 selects the mark sense signal of the upstream mark sensor 490*b* when the discontinuity sense signal is in an OFF state in the same manner as in Modification 4. When the discontinuity sense signal is in an ON state, the signal selector 484 selects the mark sense signal of the upstream mark sensor 490*b* input thereby via the delay circuit 588. The signal selector 484 therefore outputs a continuous, repeating pulse signal accurately controlled in phase, as shown in FIG. 19, so that the signal input to the PLL controller 183 is free from phase jump. It follows that the PLL controller 183 can more stably control the drive of the belt 60.

[Modification 6]

Figure 20:
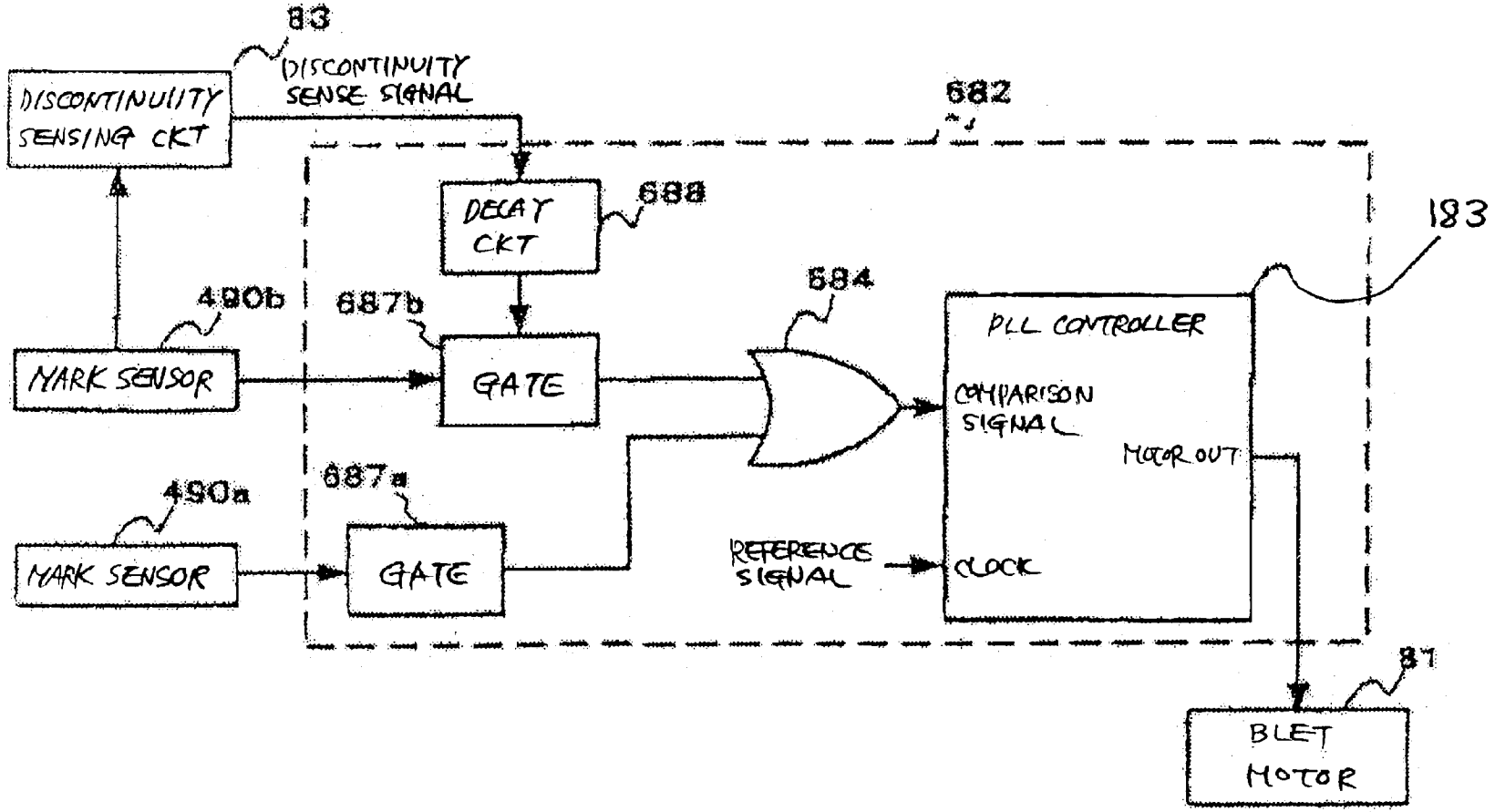
FIG. 20 is a schematic block diagram showing Modification 6 of the illustrative embodiment.

FIG. 20 shows a drive control section representative of Modification 6 that also includes two mark sensors 490*a* and 490*b*, but differs from Modification 4 or 5 in the following aspect. When the marks on the belt 60 are smeared by, e.g., toner, a mark sensor cannot stably sense the marks, resulting in inaccurate speed control. This is also true even with Modification 4 or 5 because the mark sense signal of only one of the two mark sensors 490*a* and 490*b* is fed back to the PLL controller 184. Modification 6 insures stable speed control even when the marks are smeared, as will be described hereinafter.

As shown in FIG. 20, the drive control section 682 includes an OR gate 684, gates or inhibiting means 687*a* and 687*b* and a delay circuit 688, which replace the signal selector 484 included in Modification 4. The mark sense signals output from the mark sensors 490*a* and 490*b* are input to the OR gate 684 via the gates 687*a* and 687*b*, respectively. The discontinuity sense signal output from the discontinuity sensing circuit 83 is directly input to the gate 687*b* while being input to the other gate 687*a* via the delay circuit 688.

The OR gate 684 produces an OR of the two mark sense signals substantially matched in phase to each other. Therefore, even when the discontinuous portion lies in the sensing region of one mark sensor, the OR gate 684 outputs the mark sense signal of the other mark sensor and therefore continuously outputs a repeating pulse signal. The pulse signal free from phase jump is input to the PLL controller 183 and allows the controller 183 to execute stable drive control. Moreover, even when one mark sensor cannot sense part of the marks due to smearing, the other mark sensor senses the other clean marks and sends its mark sense signal to the PLL controller 183. Stable speed control is therefore achievable despite smearing.

More specifically, when the discontinuity sense signal is input to the gate circuits 687*a* and 687*b*, the gate circuits 687*a* and 687*b* inhibit the passage of the mark sense signals output from the mark sensor 490*a* and 490*b*, respectively. The delay circuit 688 delays the timing for inputting the discontinuity sense signal to the gate circuit 687*a* by a preselected period of time relative to the timing for the same to be input to the gate circuit 687*b*. This period of time is equal to a period of time necessary for the discontinuous portion to move from the sensing region of the mark sensor 490*b* to that of the mark sensor 490*a*. Such a delay successfully prevents the mark sense signals of the mark sensors 490*a* and 490*b* from being input to the OR gate 684 when the discontinuous portion lies in the sensing regions of the mark sensors 490*a* and 490*b*.

[Modification 7]

Figure 21:
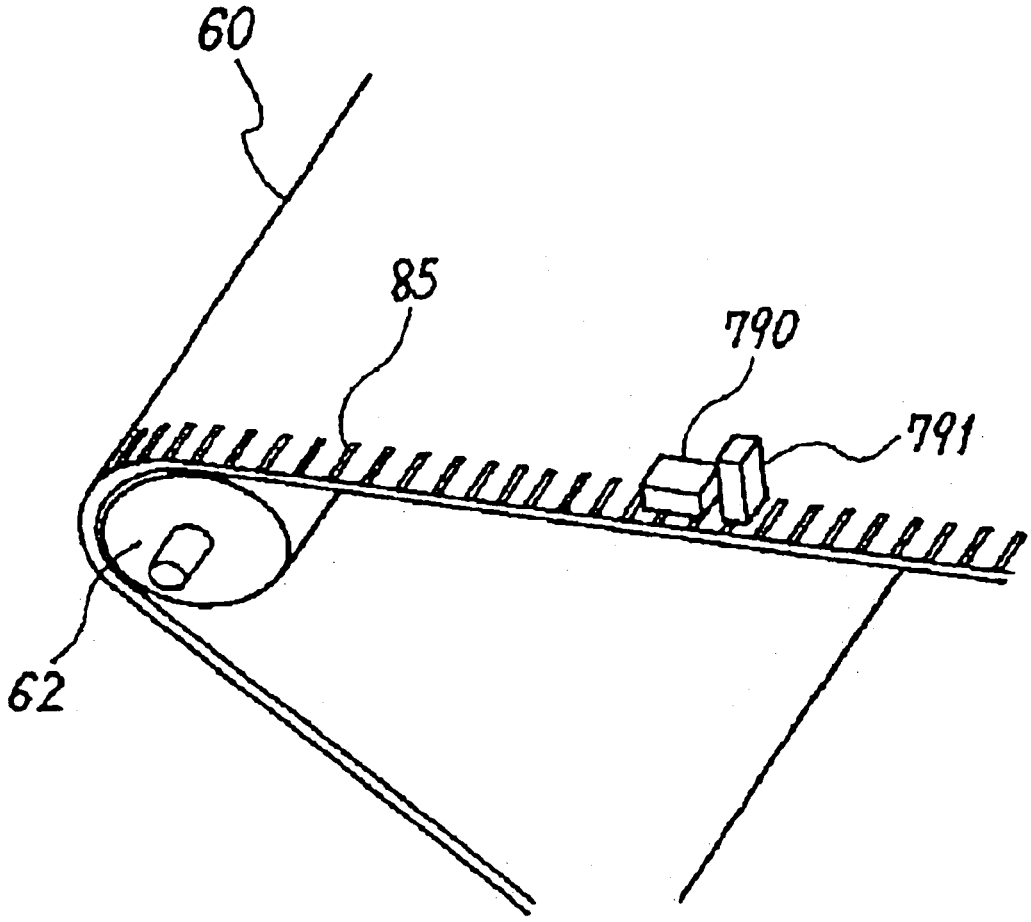
FIG. 21 shows the arrangement of two mark sensors included in Modification 7 of the illustrative embodiment.

FIG. 21 shows Modification 7 that also includes two mark sensors 790 and 791, but differs from Modifications 4 through 6 in the following aspect. To allow the discontinuous mark sensing circuit 83 to sense the discontinuous portion X, at least an interval between the time when the portion X enters the sensing region of the sensor and the time when the belt 60 moves at least a distance equal to the distance between nearby marks included in the continuous portion is necessary. Further, in the illustrative embodiment and modifications thereof, the mark sense signal input to the discontinuous mark sensing circuit 83 is used by the speed control unit as well. Therefore, a time lag occurs between the time when the discontinuity sensing circuit 83 senses the discontinuous portion X and the time when signal processing dealing with the portion X completes, resulting in phase jump although not noticeable. Modification 7 obviates the above time lag and therefore phase jump with a configuration to be described hereinafter.

Figure 22:
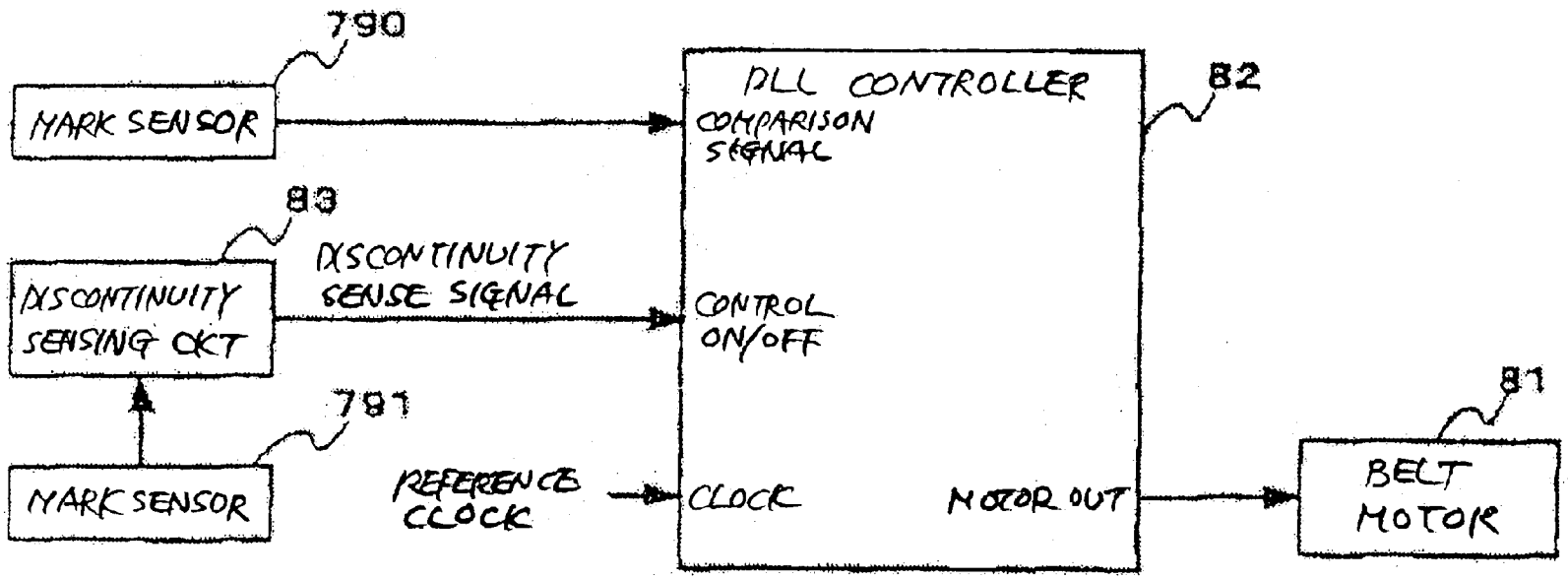
FIG. 22 is a schematic block diagram showing a drive control section included in Modification 7.

FIG. 22 shows a drive control section particular to Modification 7. As shown, the drive control section includes the two mark sensors 790 and 791, FIG. 21, discontinuity sensing circuit 83, and speed control unit 82. In Modification 7, the mark sense signal of the downstream mark sensor 790 is input only to the speed control unit 82 while the mark sense signal of the upstream mark sensor 791 is input only to the discontinuity sensing circuit 83. The mark sensor 791 responsive to discontinuity may be identical with or different from the mark sensor 790 for speed control.

The distance between the mark sensors 790 and 791 should only be selected such that before the discontinuous portion X of the belt 60 enters the sensing region of the mark sensor 790, the discontinuity sensing circuit 83 can output the discontinuity sense signal. In this configuration, before the discontinuous portion X enters the sensing region of the mark sensor 790, the speed control unit 82 can surely stop performing the PLL operation. Consequently, the time lag between the time when the circuit 83 senses the discontinuous portion X and the time when the PLL operation ends and therefore phase jump ascribable thereto is obviated.

The illustrative embodiment and Modifications 1 through 7 described above may be suitably combined, if desired.

In the illustrative embodiment and Modifications 1 through 7, the resin tape 86 with the marks 85 is adhered to the outer surface of the belt 60. Other specific methods of putting the marks 85 on the belt 60 will be described hereinafter.

Figure 23:
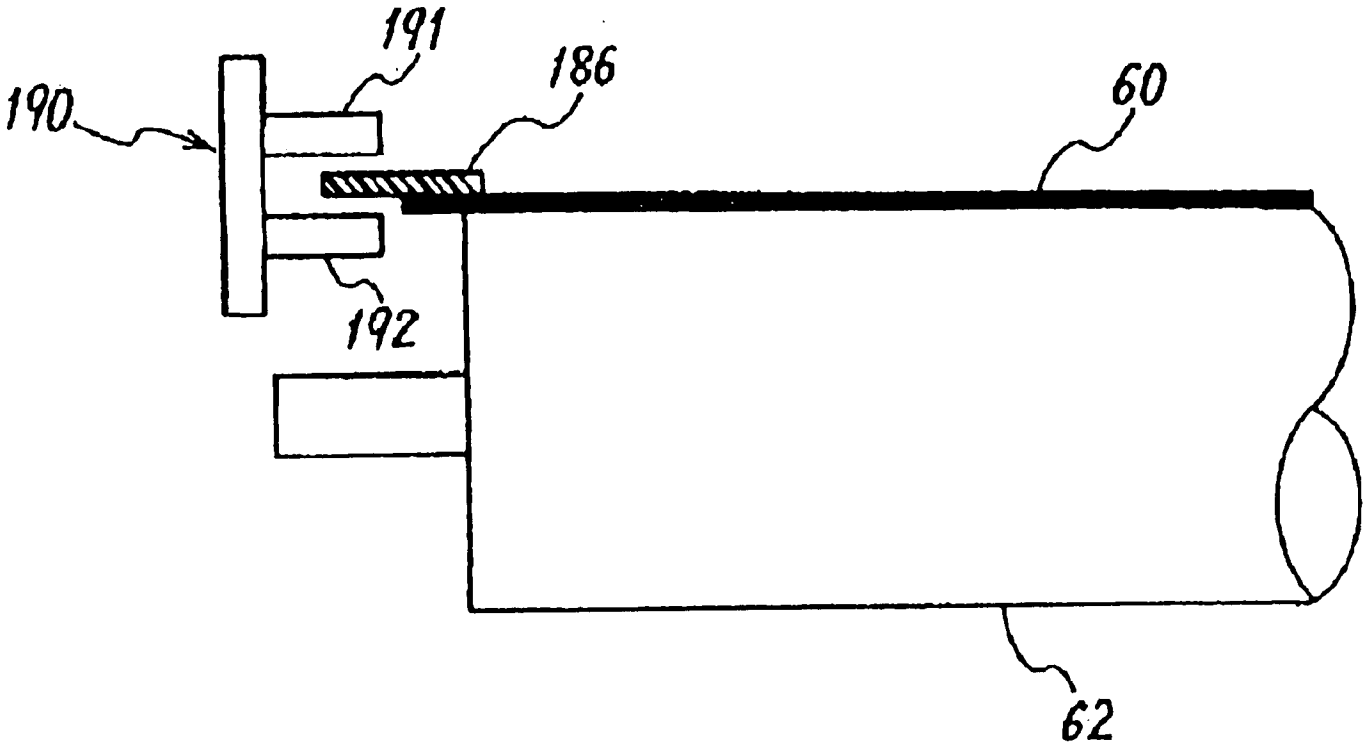
FIG. 23 is a section of a belt on which marks are formed by a specific method available with the illustrative embodiment, as seen in the direction of movement of the belt.

FIG. 23 is a section of the belt 60 as seen in the direction of movement, showing a first specific method of putting the marks 85 on the belt 60. As shown, the marks are implemented as a transmission type optical pattern and formed on a resin tape 186 as in the illustrative embodiment. The resin tape 186 is transparent for light and adhered to the belt 60 over substantially the entire circumference of the belt 60 while protruding from the belt 60 sideways, as illustrated. The resin tape 186 may be adhered to the inner surface of the belt 60, if desired.

While the illustrative embodiment and modifications thereof use a reflection type photosensor as a mark sensor, a transmission type photosensor is generally more stable than a reflection type photosensor as to sensing ability. Further, when a reflection type photosensor is used, the marks 85 are patterned on the resin tape 86 by the deposition of aluminum or similar light-reflecting material. This is undesirable from the cost standpoint. In addition, the marks 85 patterned on the resin tape 86 are apt to come off or crack at the curved portions of the belt, reducing the period of time over which a reflection type photosensor remains more stable than a transmission type photosensor.

For the reasons described above, the mark sensor 90 should preferably be implemented as a transmission type photosensor. However, carbon is, in many cases, dispersed in the belt 60 or similar endless movable member customary with an image forming apparatus in order to lower resistance. It follows that the marks 85 cannot be sensed by a transmission type photosensor if provided on the outer or the inner surface of the belt 60.

In FIG. 23, the marks on the resin tape 186 are positioned outside of the belt 60, and the belt 60 is transparent. A mark sensor 190 is made up of a light-emitting device 191 and a light-sensitive device 192 positioned to sandwich the protruding portion of the resin tape 186. With this configuration, the mark sensor 190 can surely sense the marks on the resin tape 186.

Another specific method of putting the marks on the resin tape will be described with reference to FIGS. 24. As shown, this method positions the marks on a transparent tape 286 also protruding from the edge of the belt 60 sideways. Therefore, the marks can also be sensed by the mark sensor 90, which is a transmission type photosensor.

Figure 24:
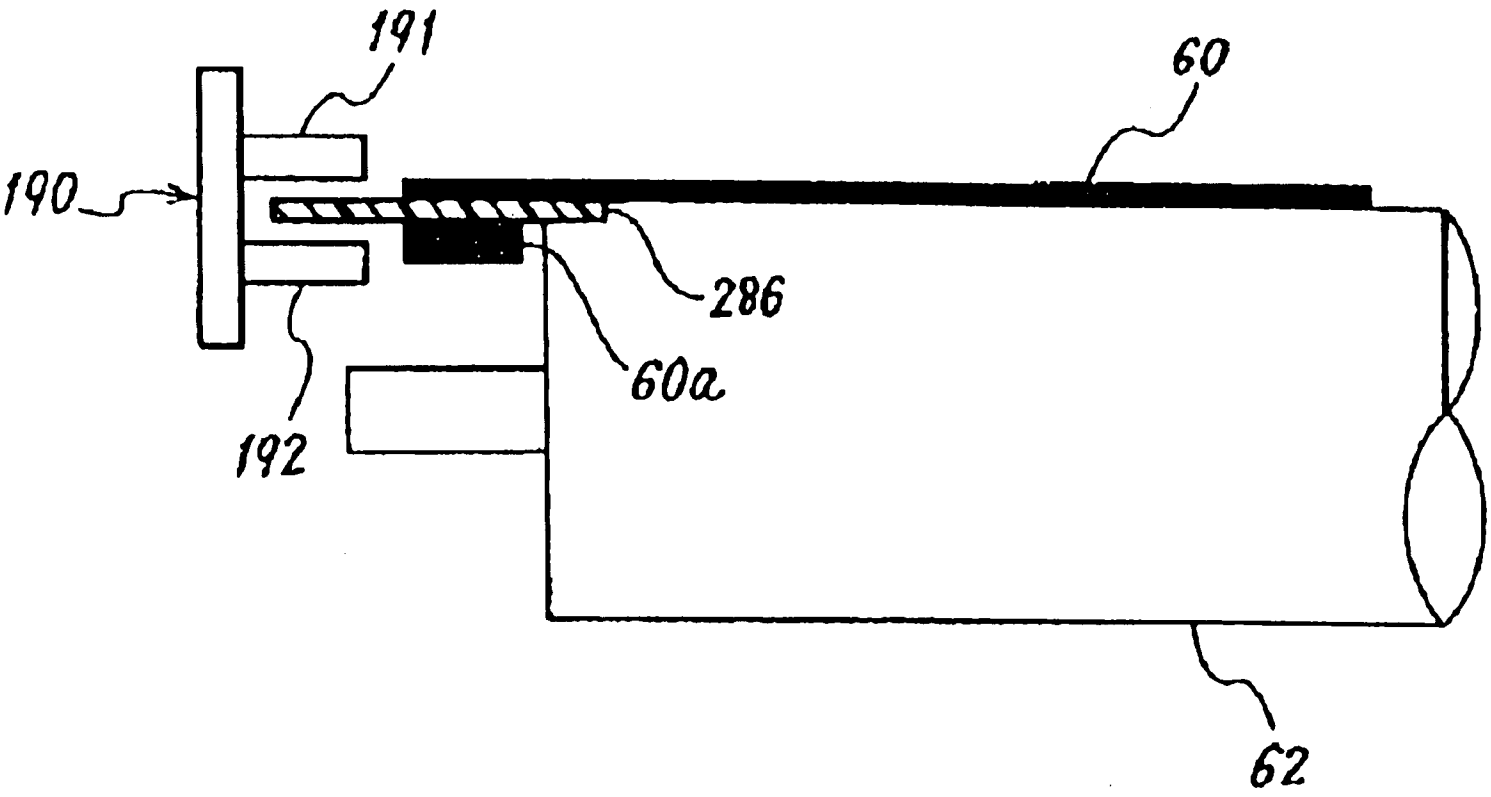
FIG. 24 is a view similar to FIG. 23, showing a belt on which marks are formed by another specific method available with the illustrative embodiment.

In FIG. 24, the resin tape 286 is adhered to the inner surface of the belt 60. An anti-offset guide 60*a* is positioned on the inner surface of the belt 60 for preventing the belt 60 from being displaced in the direction perpendicular to the direction of movement of the belt 60. The displacement or offset of the belt 60 is ascribable to errors in the mechanical accuracy and parallelism of the rollers 61 through 64 over which the belt 60 is passed. When offset occurs, the anti-offset guide 60*a* abuts against the axial end face of, e.g., the roller 62 for thereby limiting the offset. The anti-offset guide 60*a* is more convenient and lower in cost than any other anti-offset measure.

The anti-offset guide 60*a* should be provided with some thickness, so that it does not get on the rollers 61 through 64. In addition, the anti-offset guide 60*a* should be flexible like the belt 60. On the other hand, the belt 60 or similar endless moving member customary with an image forming apparatus is generally formed of polyimide or similar strong material. Considering the transfer of toner, adhesion to a sheet and cost, it is a common practice to use PVDF or similar fluorine-containing flexible material for the endless moving member. The belt 60 is also formed of PVDF. Such a material does not firmly adhere to rubber constituting the anti-offset guide 60*a*, so that the guide 60*a* is apt to come off at the curved portions of the belt 60.

In light of the above, as shown in FIG. 24, after the resin tape 286 with the marks has been adhered to the rear surface of the belt 60, the anti-offset guide 60*a* is adhered to the resin tape 286. In this configuration, the resin tape 286 reinforces the side edge portion of the belt 60 and causes it to deform little, thereby making it difficult for the anti-offset guide 60*a* from coming off from the belt 60. In the reinforcement aspect, the resin tape 286 should preferably be formed of a strong material, e.g., PET (polyethylene terephthalate) or similar polyester resin or polyimide.

Still another specific method of putting the marks on the belt 60 will be described with reference to FIG. 25. This specific method does not position the marks outside of the belt 60, but positions them on the inner surface of the belt 60. Again, the mark sensor 90 implemented as a reflection type photosensor is used.

Figure 25:
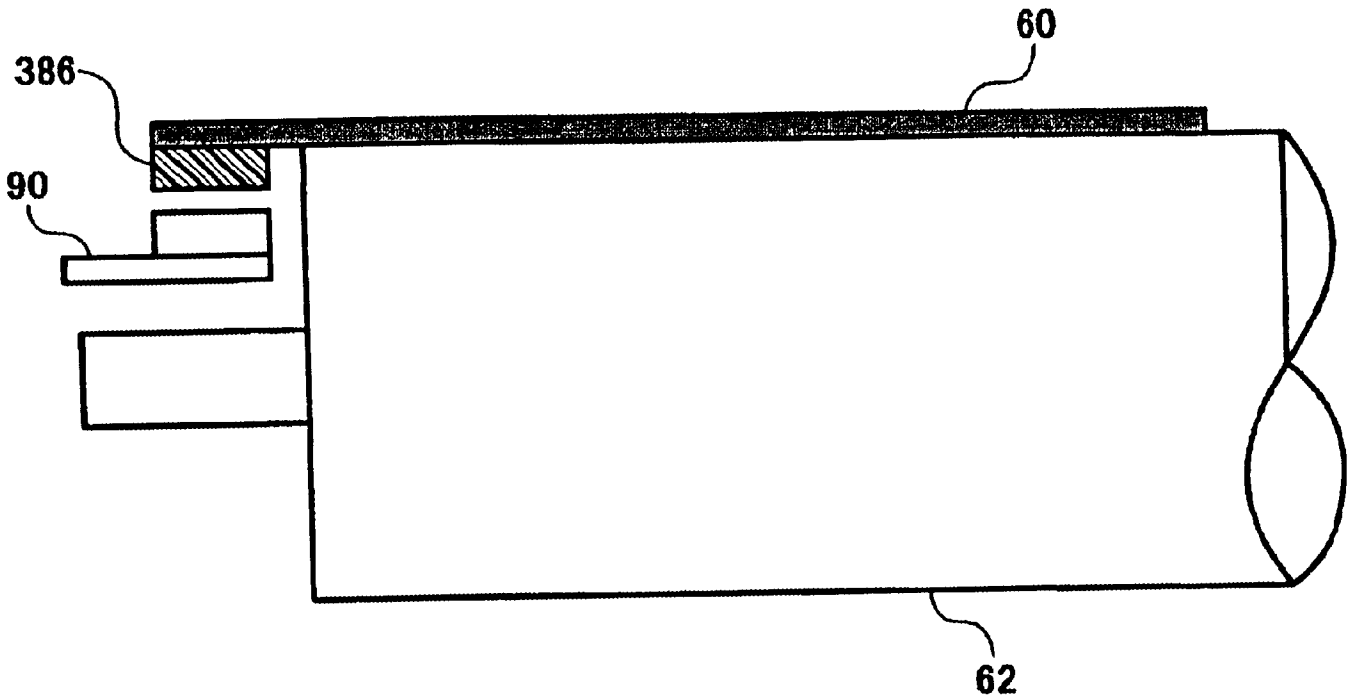
FIG. 25 is a view also similar to FIG. 23, showing a belt on which marks are formed by still another specific method available with the illustrative embodiment.

More specifically, as shown in FIG. 25, the marks are formed on an anti-offset guide 386. The anti-offset guide 386 is adhered to the inner surface of the side edge portion of the belt 60 over substantially the entire circumference of the belt 60. The anti-offset guide 386, like the anti-offset guide 60*a*, needs some thickness to serve the expected function. The marks should preferably be positioned on the belt surface to allow the behavior of the belt 60 to be accurately grasped. In such circumstances, after the marks have been formed on the surface of the anti-offset guide 386 to be adhered to the belt 60, that surface of the guide 386 is adhered to the belt 60. In this configuration, the anti-offset guide 386 must be transparent for light and is therefore formed of silicon rubber or similar transparent material. The specific method described above allows the marks to be formed at the same time as the anti-offset-guide 386 is adhered to the belt 60 by a conventional step, thereby simplifying the fabrication of the belt 60 while reducing cost.

The marks described above may be implemented as a transmission type or a reflection type scale customary with an encoder instead of an optical pattern. A linear scale using a polyester-based photoemulsion film and applicable to the above marks is extensively used with, e.g., an ink jet printer and inexpensive.

In the specific methods described above, the resin tape 86 with the marks, for example, is adhered to the belt 60 to thereby put the marks on the belt 60. Alternatively, holes may be formed in the belt 60 and positioned at preselected intervals over the entire circumference of the belt 60, serving as the marks. In this case, even when the endless movable member is opaque for light, there can be used a transparent type photosensor more advantageous than a reflection type photosensor for the reasons stated earlier. The holes can be easily formed in the belt 60 by laser trimming or similar technology.

If desired, a reflecting or a scattering material may be coated on the belt 60 and then selectively removed by laser processing to thereby form the marks. Such marks can be provided with a size of the order of several micrometers by laser processing and are therefore desirable when the mark sense signal should be provided with high resolution.

Further, the marks may be formed on the belt 60 by screen printing customary with, e.g., bookbinding. Screen printing can form the marks at high speed and is feasible for the mass production of the belts 60.

Moreover, the marks may be formed by the exposure of a photoconductive material.

An alternative embodiment of the present invention will be described hereinafter. FIGS. 1–4, 6, 8–12, 14–18, 21 and 23 and description relating thereto also apply to the alternative embodiment. The following description will therefore concentrate on differences between the previous embodiment and the alternative embodiment.

Figure 26:
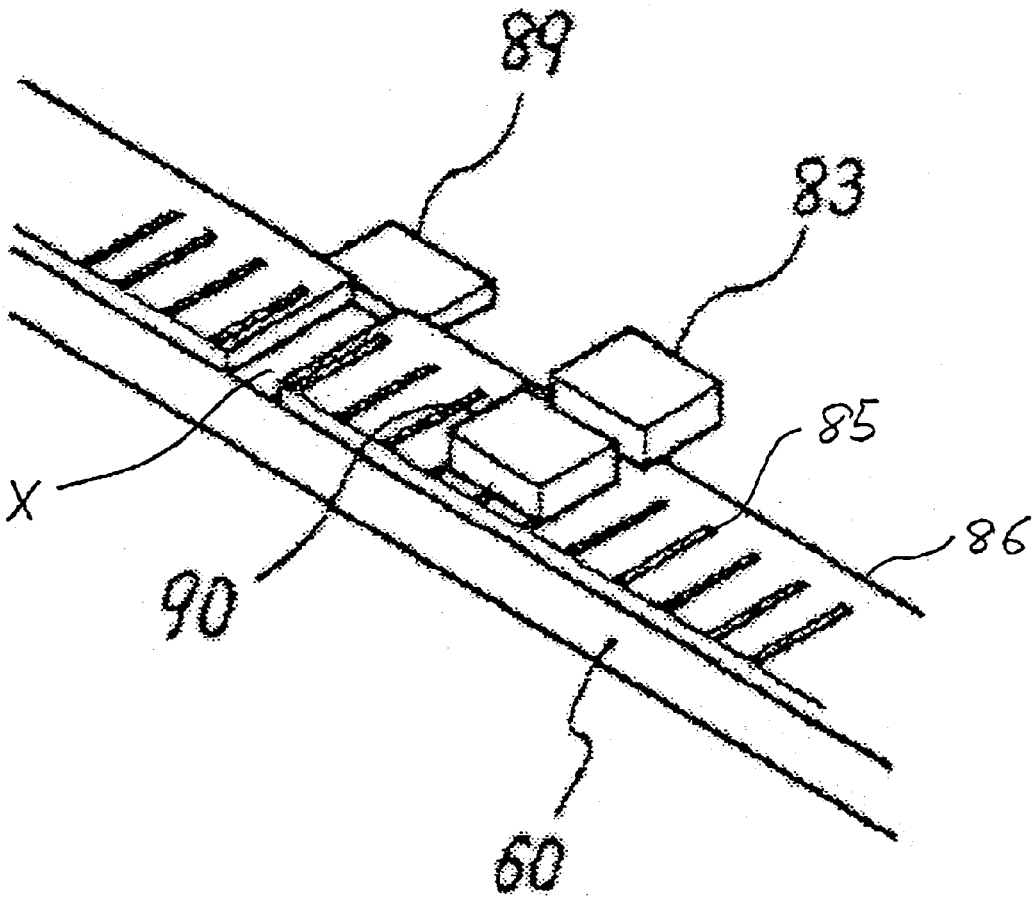
FIG. 26 is a view showing part of a belt on which marks are formed in accordance with an alternative embodiment of the present invention.

FIG. 26 shows the marks 85 put on the belt 60 in accordance with the illustrative embodiment. As shown, a discontinuity mark 89 is positioned on the belt 60 inward of the seam portion included in the marks 85. A discontinuity mark sensor 83 is positioned such that the discontinuity mark 89 on the belt 60 passes the sensor 83 in accordance with the movement of the belt 60. On sensing the discontinuity mark 89, the discontinuity mark sensor 83 sends a discontinuity sense signal to the control ON/OFF terminal of the speed control unit 82. The discontinuity mark sensor 83 is a reflection type photosensor like the mark sensor 90.

Discontinuity mark sensing means responsive to the discontinuity mark 89 is not limited to a reflection type photosensor. Because the discontinuity mark sensing means does not have to continuously sense the plurality of marks 85 like the mark sensor 90, use may be made of sensing means lower in cost than, e.g., an encoder head feasible for the sensing of continuous marks.

In the illustrative embodiment, the discontinuity mark 89 is provided with a length, as measured in the direction of movement of the belt 60, greater than the distance between the marks facing each other with the intermediary of the seam portion. This relation is selected in consideration of, e.g., the sensing accuracy of the discontinuity mark sensor 83 and a time lag between the time when the sensor 83 senses the discontinuity mark 89 and the time when the resulting discontinuity sense signal is input to the control ON/OFF terminal of the speed control unit 82. In this configuration, the PLL operation is interrupted just before the discontinuous portion X arrives at the sensing region of the mark sensor 90, and then resumed as soon as the discontinuous portion X moves away from the above sensing region. The illustrative embodiment can therefore surely inhibit the PLL operation when the discontinuous portion X is present in the sensing region of the mark sensor 90.

If desired, the discontinuity mark 89 may be positioned outward of the side edge of the belt 60 in the vicinity of the seam portion, protruding from the belt 60 sideways. In this case, the discontinuity mark 89 can be sensed by a transmission type photosensor more advantageous than a reflection type photosensor for the reasons stated previously. Further, the discontinuity mark 89 may not be positioned beside the seam portion, but may precede or follow the seam portion in the direction of movement of the belt 60. Even in this case, because the target speed of the belt 60 is preselected, the time when the discontinuous portion X will be present in the sensing range of the mark sensor 90 can be determined in accordance with the target speed.

In the illustrative embodiment, the discontinuity sensor 83 is located at the same position as the downstream mark sensor 490*b* in the direction of movement of he belt 60. Therefore, the discontinuity mark sensor 83 continuously outputs the discontinuity sense signal so long as the discontinuous portion X is present in the sensing region of the upstream mark sensor 490*a*.

A modification of the illustrative embodiment will be described hereinafter.

[Modification 8]

Figure 27:
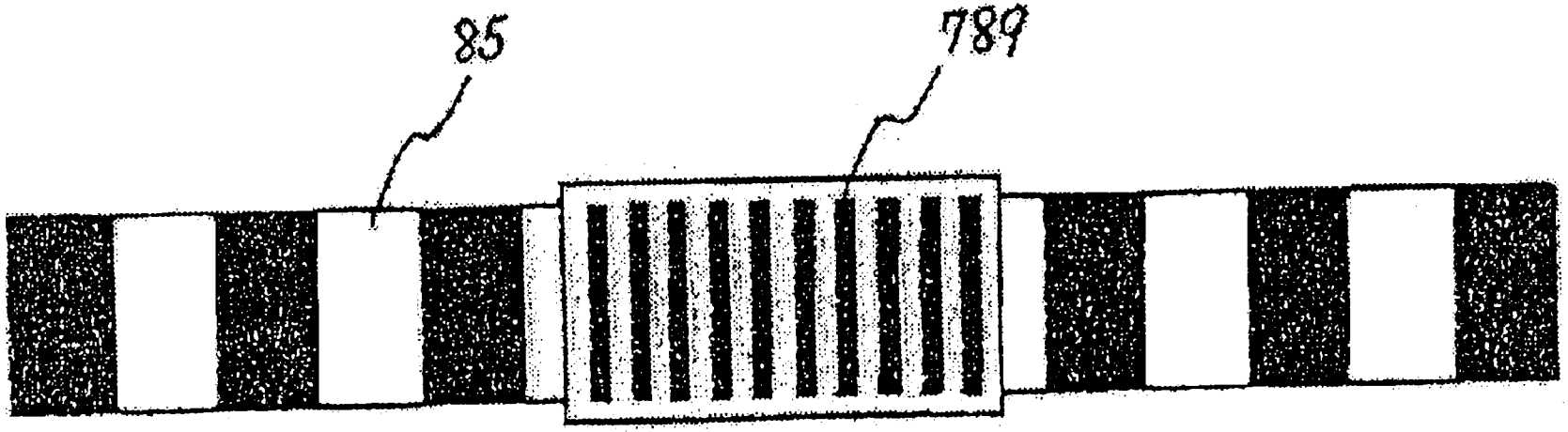
FIG. 27 shows a specific configuration of discontinuity marks particular to Modification 8 of the alternative embodiment.

In the illustrative embodiment, the discontinuity mark 89 is positioned beside and inward of the discontinuous portion X. In Modification 8, the discontinuity mark is positioned within the discontinuity mark is positioned within the discontinuous portion X on the belt 60. More specifically, as shown in FIG. 27, a tape formed with a plurality of discontinuity marks 789 is adhered to the seam portion between opposite ends of the resin tape 86, which is formed with the marks 85 and also adhered to the belt 86. The discontinuity marks 789, like the marks 85 of the tape 85, are implemented as an optical pattern. The distance between nearby discontinuity marks 789 is shorter than the distance between nearby marks 85.

Figure 28:
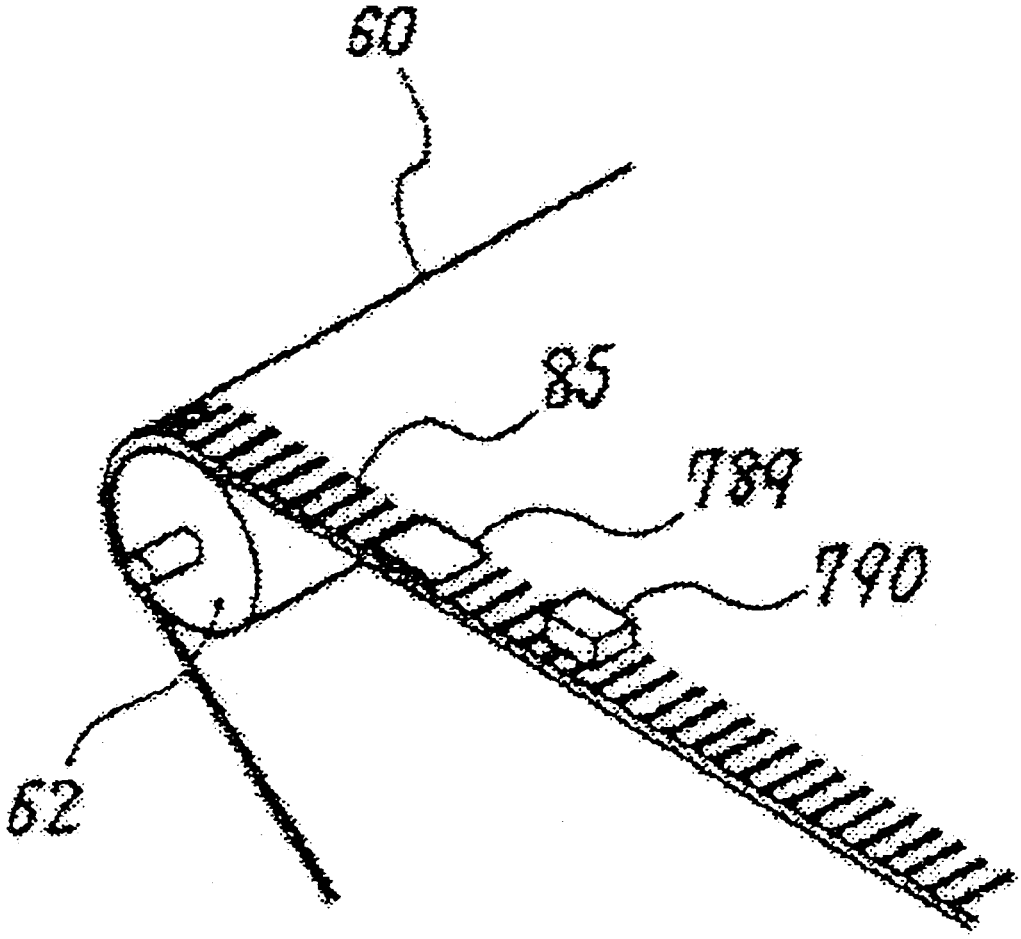
FIG. 28 is a fragmentary view showing part of the belt where the discontinuity marks are positioned.

As shown in FIG. 28, Modification 8 does not include an exclusive mark sensor responsive to the discontinuity marks 789, but assigns the function of the mark sensing means and that of the discontinuity mark sensing means to a single mark sensor 790. Because the distance between nearby discontinuity marks is shorter than the distance between nearby marks 85, it is possible to sense the discontinuity marks 789 on the basis of a pulse period of the mark sense signal output from the mark sensor 790.

Figure 29:
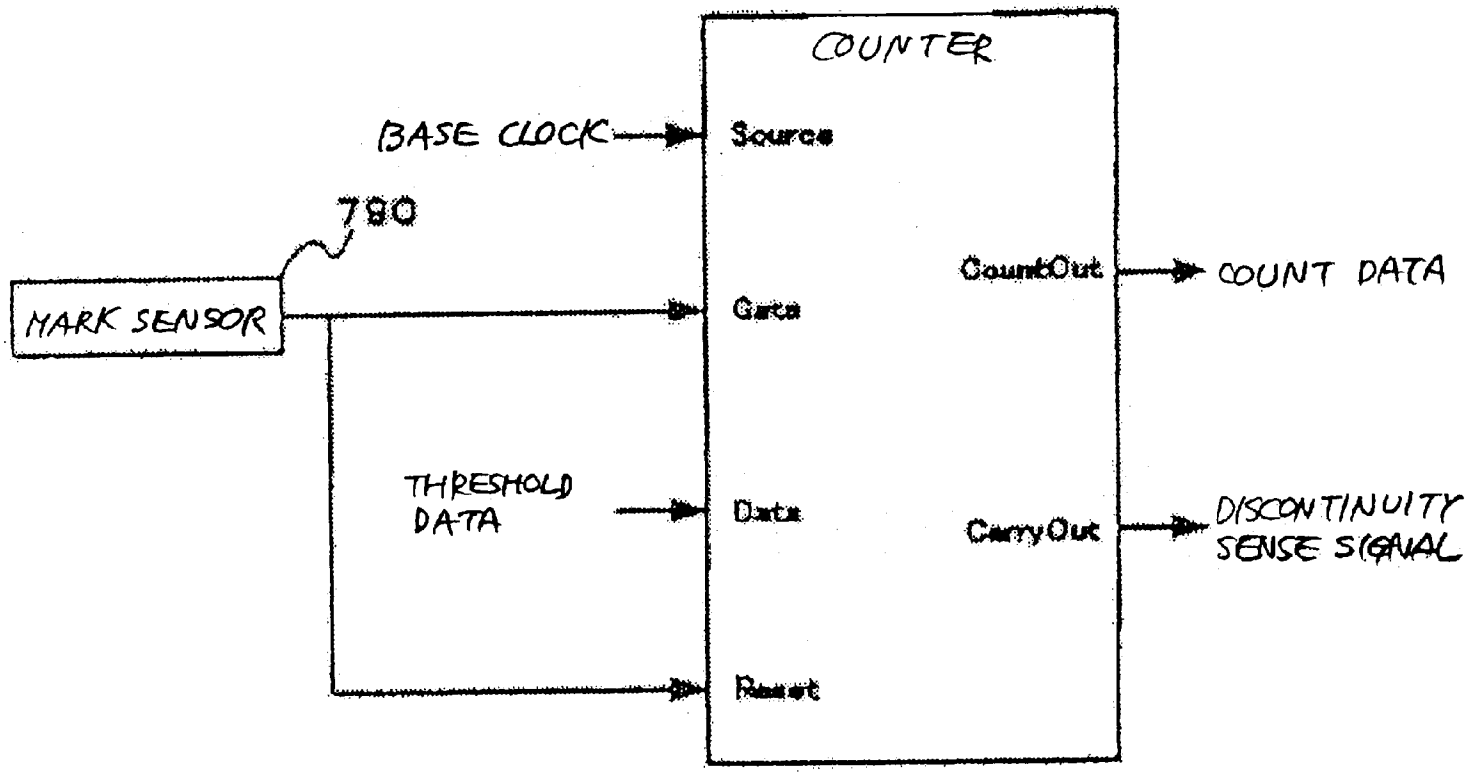
FIG. 29 is a schematic block diagram showing a discontinuity mark sensing circuit included in Modification 8.

FIG. 29 shows a discontinuity mark sensing circuit or discontinuity sensing means 783 for sensing the discontinuity marks 789 unique to Modification 8. As shown, the circuit 783 is implemented as a conventional counter circuit including a source terminal to which a base clock is input and a gate and a reset terminal to which the mark sense signal is input. The base clock is a repeating pulse signal whose period is far shorter than the pulse period of the mark sense signal derived from the discontinuity marks 789. The circuit 783 increments count data every time the base clock is input. The count data is reset at the positive-going edge of the base clock input for the first time when the mark sense signal is being input to the gate terminal. Preselected threshold data is input to a data terminal also included in the circuit 783. The threshold data is selected to be greater than the maximum value of the count data derived from the discontinuity marks 789, but smaller than the maximum value of the count data derived from the continuous marks 85.

In the above configuration, the count data derived from the discontinuity marks 789 is reset before reading the threshold value, but the count data derived from the continuous marks 85 is reset after reaching the threshold value. When the count data is reset before reaching the threshold value, a discontinuity sense signal is output via a carry out terminal included in the circuit 783.

Figure 30:
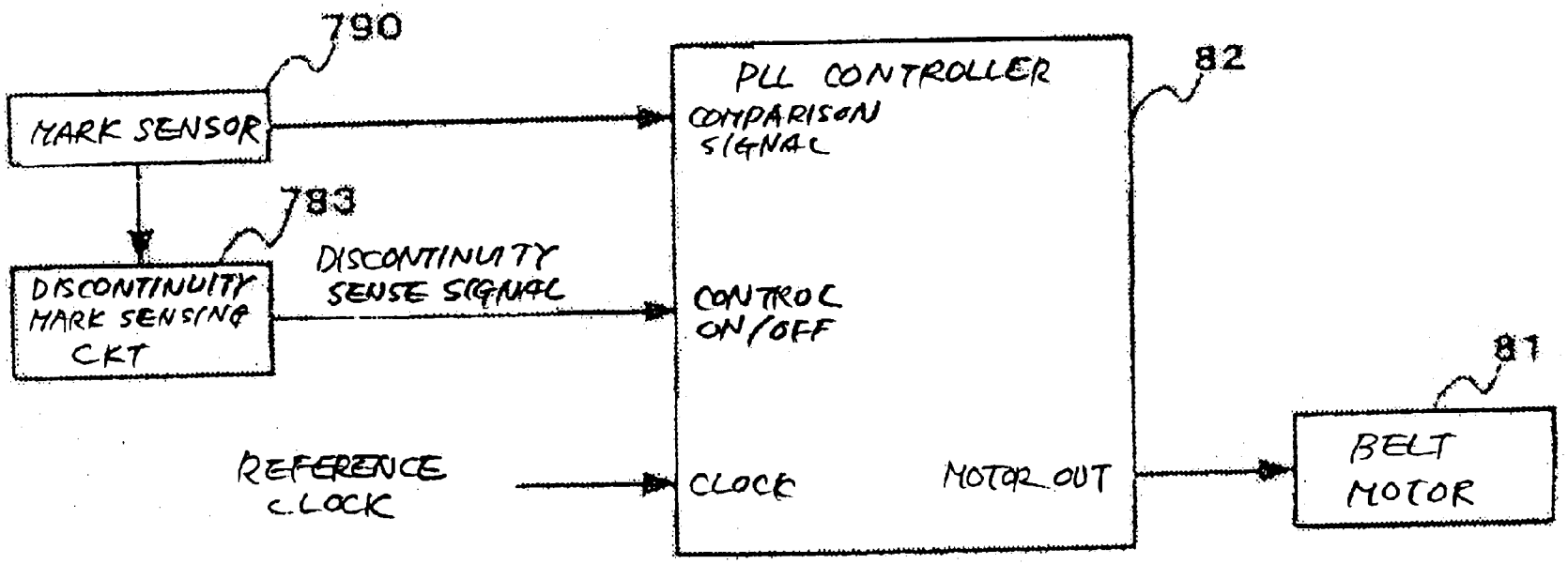
FIG. 30 is a schematic block diagram showing a drive control section included in Modification 8.

FIG. 30 shows a drive control section included in Modification 8. As shown, the drive control section, like the speed control unit 82, uses a PLL controller. The mark sense signal output from the mark sensor 790 is input to the comparison terminal of the PLL controller 82 and discontinuous mark sensing circuit 783. The discontinuity sense signal output from the discontinuity mark sensing circuit 783 is input to the control ON/OFF terminal of the PLL controller 82. In response, the PLL controller 82 stops performing the PLL operation, so that a drive signal in a condition free from phase shift can be sent to the belt motor 81.

While Modification 8 includes a single mark sensor 790 bifunctioning as discontinuity mark sensing means and mark sensing means, it may, of course, be replaced with two sensors each functioning as particular mark sensing means. The discontinuity marks 789 can be sensed so long as the distance between them is sufficiently shorter than the distance between the continuous marks 85 and therefore do not need high accuracy. The discontinuity marks 789 can therefore be formed more easily than the marks 85 positioned on the resin tape 86.

The belt 60 to which the resin tape 86 is adhered is apt to crack due to repeated bending and stretching. Particularly, cracks are apt to appear at the side edges of the belt 60. In the embodiments and modifications shown and described, a reinforcing member is absent in the seam portion of the resin tape 86. In this sense, the tape formed with the discontinuity marks 789 and adhered to the seam portion successfully reinforces the seam portion, thereby making the belt 60 more resistant to cracking.

Further, while the resin tape 86 is apt to come off from the belt 60 in the seam portion, Modification 8 reduces such an occurrence.

The illustrative embodiments and Modifications 1 through 8 thereof may be suitably combined, if desired.

Figure 31:
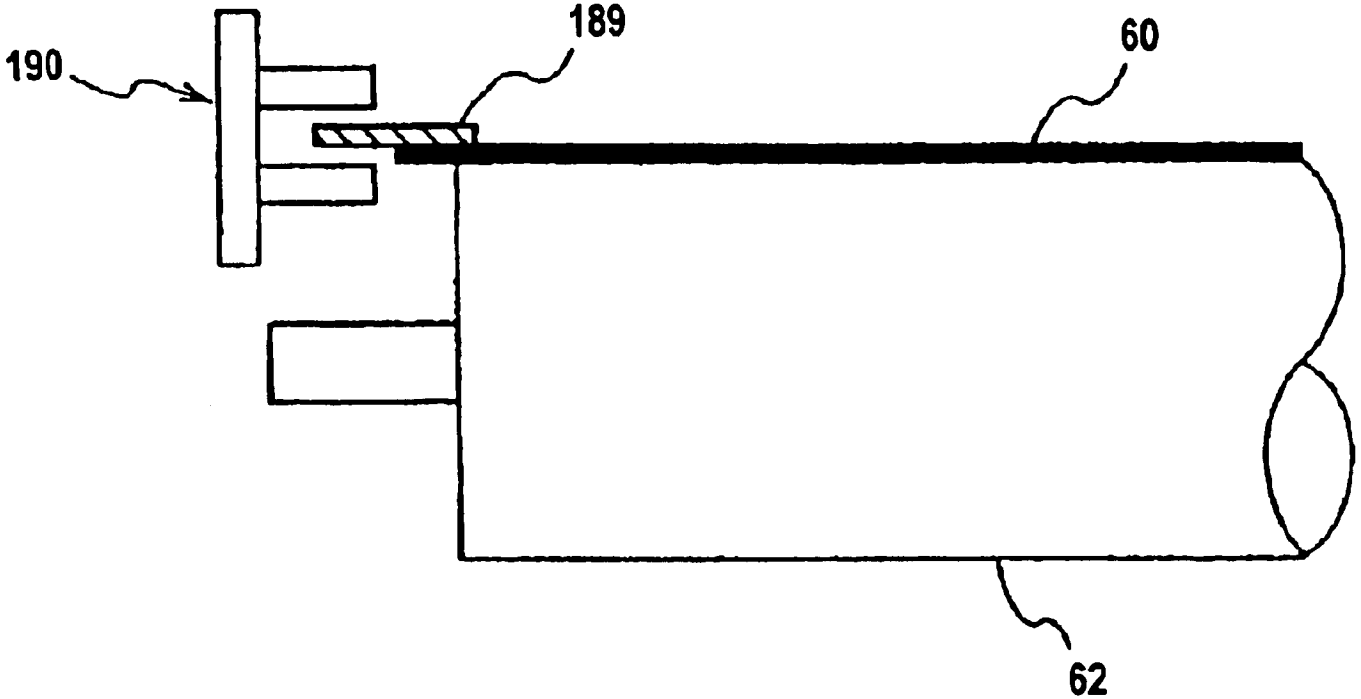
FIG. 31 is a section showing another specific configuration of the belt provided with the discontinuity marks.

FIG. 31 shows a specific method of forming the discontinuity marks 189 on the belt 60. The configuration shown in FIG. 31 is identical with the configuration of FIG. 23 except that it pertains to the discontinuity marks 189.

The illustrative embodiments and Modifications 1 through 8 thereof have concentrated on an image forming apparatus of the type directly transferring toner images from the drums 11M through 11K to a sheet one above the other. The present invention is similarly applicable to an image forming apparatus of the type transferring the toner images to a sheet by way of an intermediate image transfer body. Further, the present invention is also practicable with a monochromatic or a color image forming apparatus including a single photoconductive drum, as distinguished from the tandem image forming apparatus including the four drums 11M through 11K.

Any one of the drive control sections shown and described is similarly applicable to a device for controlling the speed of an endless belt member, drum member or similar endless movable member, e.g., a photoconductive drum, a photoconductive belt or an intermediate image transfer belt.

While the resin tape 86 has been shown and described as including a single seam portion or discontinuous portion, it may, of course, include a plurality of seam portions.

Moreover, the mark sensor configured to output a pulse signal on sensing a mark may be replaced with an analog sensor that outputs a sinusoidal signal in accordance with the presence/absence of a mark. In such a case, use may be made of a multiplier configured to generate pulses in the same phase in accordance with the amplitude of the analog sensor output for thereby enhancing resolution. This successfully broadens a control frequency band to thereby realize control over high-frequency speed or position variation.

In summary, in accordance with the present invention, even when marks continuously put on the belt 60 at preselected intervals in the direction of movement of the belt 60 include a discontinuous portion not lying in a preselected range, drive control not using a mark sense signal derived from the discontinuous portion is achievable. The drive of the belt 60 can therefore be adequately controlled.

Various modifications will become possible for those skilled in the art after receiving the teachings of the present disclosure without departing from the scope thereof.

What is claimed is:

1. A device for controlling drive of an endless movable member, said device comprising:

mark sensing means for sensing at least two pairs of marks each separated from one another at preselected intervals and another pair of marks separated by a distance greater than the preselected intervals, the at least two pair of marks and the another pair of marks continuously positioned on the endless movable member in a direction of movement of said movable member;

speed/position control means for controlling either one of a speed and a position of the moveable member by using an output of said mark sensing means; and discontinuity sensing means for determining whether or not a discontinuous portion is present in a sensing region assigned to said mark sensing means, the discontinuous portion arranged at least between the another pair of marks, wherein said speed/position control means is configured to vary speed control or position control in accordance with an output of said discontinuity sensing means.

2. The device as claimed in claim 1, wherein when the discontinuous portion is present in the sensing region of said mark sensing means, said speed/position control means executes speed control or position control in a manner different from when a continuous portion arranged at least between each of the at least two pairs of marks is present in said sensing region.

3. The device as claimed in claim 2, further comprising dummy signal generating means for determining a mean value of intervals of outputs of said mark sensing means derived from the continuous portion to thereby generate a dummy signal, which repeats at said mean value, wherein when the discontinuous portion is present in the sensing region of said mark sensing means, said speed/position control means executes the speed control or the position control by using the dummy signal in place of the output of said mark sensing means.

4. The device as claimed in claim 2, wherein said speed/position control means comprises memory means for storing a content of the output of said mark sensing means when the continuous portion is present in the sensing region of said mark sensing means, and wherein when the discontinuous portion is present in the sensing region of said mark sensing means, said speed/position control means executes the speed control or the position control by using a signal corresponding to the content stored in said memory means in place of the output of the mark sensing means.

5. The device as claimed in claim 4, wherein the content stored in said memory means is based on an interval between signals output from said mark sensing means.

6. The device as claimed in claim 1, wherein said speed/position control means executes the speed control or the position control by using a frequency signal based on the output of said mark sensing means.

7. The device as claimed in claim 6, wherein said speed/position control means comprises frequency signal generating means for generating the frequency signal, and said speed/position control means causes said frequency signal generating means to generate, when the continuous portion is present in the sensing region of said mark sensing means, a frequency signal whose frequency is based on the output of said mark sensing means or generate, when the discontinuous portion is present in said sensing region, a frequency signal based on a signal different from said output of said mark sensing means and substantially identical in frequency with said frequency signal.

8. The device as claimed in claim 1, wherein said speed/position control means executes the speed control or the position control by using a voltage signal based on the output of said mark sensing means.

9. The device as claimed in claim 1, wherein said mark sensing means comprises a plurality of mark sensors spaced from each other by a distance greater than a length of the discontinuous portion in the direction of movement of said movable member, and said speed/position control means executes the speed control or the position control by using an output of one of said plurality of mark sensors not sensing the discontinuous portion.

10. The device as claimed in claim 9, wherein said speed/position control means further comprises phase comparing means for comparing phases of output periods of said mark sensing means, and said speed/position control means uses, as for at least one of said mark sensors, an output corrected by a phase difference derived from a result of comparison executed by said phase comparing means.

11. The device as claimed in claim 1, wherein said mark sensing means comprises a plurality of mark sensors spaced from each other by a distance greater than a length of the discontinuous portion in the direction of movement of said movable member, said speed/position control means comprises ORing means for producing an OR of outputs of said mark sensors substantially matched in phase to each other, and inhibiting means for inhibiting said ORing means from using the output of one of said mark sensors sensing the discontinuous portion, and said speed/position control means executes the speed control or the position control by using the OR output from said ORing means.

12. The device as claimed in claim 1, wherein said mark sensing means comprises a mark sensor assigned to said discontinuity sensing means independently of said mark sensor assigned to said speed/position control means.

13. An image forming apparatus comprising:

an endless movable member formed with a plurality of marks continuously positioned in a direction of movement of said endless movable member;

drive transmitting means for transmitting a drive force to said movable member to thereby cause said movable member to move; and drive control means for controlling drive of said drive transmitting means, said drive control means including, mark sensing means for sensing at least two pairs of marks each separated from one another at preselected intervals and another pair of marks separated by a distance greater than the preselected intervals, speed/position control means for controlling either one of a speed and a position of the moveable member by using an output of said mark sensing means, and discontinuity sensing means for determining whether or not a discontinuous portion is present in a sensing region assigned to said mark sensing means, the discontinuous portion arranged at least between the another pair of marks, wherein said speed/position control means is configured to vary speed control or position control in accordance with an output of said discontinuity sensing means.

14. The apparatus as claimed in claim 13, wherein the marks are formed on a flexible member adhered to said movable member in the direction of movement.

15. The apparatus as claimed in claim 14, wherein the flexible member functions as a guide member for preventing said movable member from being displaced in a direction perpendicular to the direction of movement.

16. The apparatus as claimed in claim 13, wherein said movable member comprises either one of an image carrier and a support member configured to support a recording medium, and the preselected intervals each are substantially equal to a resolution of an image in the direction of movement or an integral ratio thereof.

17. A drive control device for controlling drive of an endless movable member, said drive control device comprising:

mark sensing means for sensing at least two pairs of marks each separated from one another at preselected intervals and a pair of discontinuity marks separated by a distance greater than the preselected intervals, the at least two pair of marks and the pair of discontinuity marks continuously positioned on the movable member in a direction of movement of said movable member;

speed/position control means for controlling either one of a speed and a position of the moveable member with a control signal based on an output of said mark sensing means; and discontinuity mark sensing means for sensing the pair of discontinuity marks and indicating a position of a discontinuous portion arranged at least between the pair of discontinuity marks;

wherein said speed/position control means is configured to vary speed control or position control in accordance with an output of said discontinuity mark sensing means.

18. The device as claimed in claim 17, wherein when the discontinuous portion is present in the sensing region of said mark sensing means, said speed/position control means executes speed control or position control in a manner different from when a continuous portion arranged at least between each of the at least two pairs of marks is present in said sensing region.

19. The device as claimed in claim 18, further comprising dummy signal generating means for determining a mean value of intervals of outputs of said mark sensing means derived from the continuous portion to thereby generate a dummy signal, which repeats at said mean value, wherein when the discontinuous portion is present in the sensing region of said mark sensing means, said speed/position control means executes the speed control or the position control by using the dummy signal in place of the output of said mark sensing means.

20. The device as claimed in claim 18, wherein said speed/position control means comprises memory means for storing a content of the output of said mark sensing means when the continuous portion is present in the sensing region of said mark sensing means, wherein when the discontinuous portion is present in the sensing region of said mark sensing means, said speed/position control means executes the speed control or the position control by using a signal corresponding to the content stored in said memory means in place of the output of the mark sensing means.

21. The device as claimed in claim 20, wherein the content stored in said memory means is based on an interval between signals output from said mark sensing means.

22. The device as claimed in claim 17, wherein said speed/position control means executes the speed control or the position control by using a frequency signal based on the output of said mark sensing means.

23. The device as claimed in claim 22, wherein said speed/position control means comprises frequency signal generating means for generating the frequency signal, wherein said speed/position control means causes said frequency signal generating means to generate, when the continuous portion is present in the sensing region of said mark sensing means, a frequency signal whose frequency is based on the output of said mark sensing means or generate, when the discontinuous portion is present in said sensing region, a frequency signal based on a signal different from said output of said mark sensing means and substantially identical in frequency with said frequency signal.

24. The device as claimed in claim 17, wherein said speed/position control means executes the speed control or the position control by using a voltage signal based on the output of said mark sensing means.

25. The device as claimed in claim 17, wherein said mark sensing means comprises a plurality of mark sensors spaced from each other by a distance greater than a length of the discontinuous portion in the direction of movement of said movable member, and said speed/position control means executes the speed control or the position control by using an output of one of said plurality of mark sensors not sensing the discontinuous portion.

26. The device as claimed in claim 25, wherein said speed/position control means further comprises phase comparing means for comparing phases of output periods of said mark sensing means, and said speed/position control means uses, as for at least one of said mark sensors, an output corrected by a phase difference derived from a result of comparison executed by said phase comparing means.

27. The device as claimed in claim 17, wherein said mark sensing means comprises a plurality of mark sensors spaced each other by a distance greater than a length of the discontinuous portion in the direction of movement of said movable member, said speed/position control means comprises ORing means for producing an OR of outputs of said mark sensors substantially matched in phase to each other, and inhibiting means for inhibiting said ORing means from using the output of one of said mark sensors sensing the discontinuous portion, and said speed/position control means executes the speed control or the position control by suing the OR output from said ORing means.

28. An image forming apparatus comprising:

an endless movable member formed with a plurality of marks in a direction of movement of said endless movable member;

drive transmitting means for transmitting a drive force to said movable member to thereby cause said movable member to move; and drive control means for controlling drive of said drive transmitting means, wherein said plurality of marks include at least two pairs of marks each separated from one another at preselected intervals and a pair of discontinuity marks separated by a distance greater than the preselected intervals, the discontinuity marks indicative of a position, in the direction of movement, of a discontinuous portion arranged at least between the pair of discontinuity marks, and said drive control means includes, mark sensing means for sensing the marks positioned on said movable member, speed/position control means for controlling either one of a speed and a position with a control signal based on an output of said mark sensing means, and discontinuity mark sensing means for sensing the discontinuity marks, wherein said speed/position control means is configured to vary speed control or position control in accordance with an output of said discontinuity mark sensing means.

29. A device for controlling drive of an endless movable member, said device comprising:

mark sensing means for sensing a plurality of marks continuously positioned on the endless movable member at preselected intervals in a direction of movement of said movable member; discontinuity sensing means for determining whether or not a discontinuous portion, in which a distance between nearby marks does not lie in a preselected range, is present in a sensing region assigned to said mark sensing means;

speed/position control means for controlling either one of a speed and a position by using an output of said mark sensing means and for varying speed control or position control in accordance with an output of said discontinuity sensing means; and dummy signal generating means for determining a mean value of intervals of outputs of said mark sensing means derived from a continuous portion, in which the distance between nearby marks lies in the preselected range, to thereby generate a dummy signal which repeats at said mean value, wherein, when the discontinuous portion is present in the sensing region of said mark sensing means, said speed/position control means executes speed control or position control in a manner different from when the continuous portion is present in said sensing region, and when the discontinuous portion is present in the sensing region of said mark sensing means, said speed/position control means executes the speed control or the position control by using the dummy signal in place of the output of said mark sensing means.

30. A device for controlling drive of an endless movable member, said device comprising:

mark sensing means for sensing a plurality of marks continuously positioned on the endless movable member at preselected intervals in a direction of movement of said movable member;

discontinuity sensing means for determining whether or not a discontinuous portion, in which a distance between nearby marks does not lie in a preselected range, is present in a sensing region assigned to said mark sensing means; and speed/position control means for controlling either one of a speed and a position based on an output of said mark sensing means and for varying speed control or position control in accordance with an output of said discontinuity sensing means, said speed/position control means including memory means for storing a content of an output of said mark sensing means when a continuous portion, in which the distance between nearby marks lies in the preselected range, is present in the sensing region of said mark sensing means, wherein, when the discontinuous portion is present in the sensing region of said mark sensing means, said speed/position control means executes speed control or position control in a manner different from when the continuous portion is present in said sensing region, and when the discontinuous portion is present in the sensing region of said mark sensing means, said speed/position control means executes the speed control or the position control by using a signal corresponding to the content stored in said memory means m place of the output of the mark sensing means.

31. The device as claimed in claim 30, wherein the content stored in said memory means is based on an interval between signals output from said mark sensing means.

32. A device for controlling drive of an endless movable member, said device comprising:

mark sensing means for sensing a plurality of marks continuously positioned on the endless movable member at preselected intervals in a direction of movement of said movable member;

discontinuity sensing means for determining whether or not a discontinuous portion, in which a distance between nearby marks does not lie in a preselected range, is present in a sensing region assigned to said mark sensing means; and speed/position control means for controlling either one of a speed and a position by using a frequency signal based on an output of said mark sensing means and for varying speed control or position control based on an output of said discontinuity sensing means, said speed/position control means including frequency signal generating means for generating frequency signals, wherein said speed/position control means causes said frequency signal generating means to generate, when the continuous portion is present in the sensing region of said mark sensing means, a frequency signal whose frequency is based on the output of said mark sensing means or generate, when the discontinuous portion is present in said sensing region, a frequency signal based on a signal different from said output of said mark sensing means and substantially identical in frequency with said frequency signal.

33. A device for controlling drive of an endless movable member, said device comprising:

mark sensing means for sensing a plurality of marks continuously positioned on the endless movable member at preselected intervals in a direction of movement of said movable member, said mark sensing means including a plurality of mark sensors spaced from each other, in the direction of movement of said movable member, by a distance greater than a length of a discontinuous portion in which a distance between nearby marks does not lie in a preselected range;

discontinuity sensing means for determining whether or not the discontinuous portion is present in a sensing region assigned to said mark sensing means; and speed/position control means for controlling either one of a speed and a position by using an output of said mark sensing means and for varying speed control or position control in accordance with an output of said discontinuity sensing means, said speed/position control means includes phase comparing means for comparing phases of output periods of said mark sensing means, wherein said speed/position control means executes the speed control or the position control by using an output of one of said plurality of mark sensors not sensing the discontinuous portion, and said speed/position control means uses as for at least one of said mark sensors an output corrected by a phase difference derived from a result of comparison executed by said phase comparing means.

34. A device for controlling drive of an endless movable member, said device comprising:

mark sensing means for sensing a plurality of marks continuously positioned on the endless movable member at preselected intervals in a direction of movement of said movable member, said mark sensing means including a plurality of mark sensors spaced from each other, in the direction of movement of said movable member, by a distance greater than a length of a discontinuous portion in which a distance between nearby marks does not lie in a preselected range;

discontinuity sensing means for determining whether or not the discontinuous portion is present in a sensing region assigned to said mark sensing means; and speed/position control means for controlling either one of a speed and a position by using an output of said mark sensing means and for varying speed control or position control in accordance with an output of said discontinuity sensing means, said speed/position control means including ORing means for producing an OR of outputs of said mark sensors substantially matched in phase to each other, and including inhibiting means for inhibiting said ORing means from using the output of one of said mark sensors sensing the discontinuous portion, wherein said speed/position control means executes the speed control or the position control by using the OR output from said ORing means.

35. An image forming apparatus comprising:

an endless movable member formed with a plurality of marks at preselected intervals in a direction of movement of said endless movable member;

drive transmitting means for transmitting a drive force to said movable member to thereby cause said movable member to move; and drive control means for controlling drive of said drive transmitting means, said drive control means including, mark sensing means for sensing the marks positioned on the movable member and formed on a flexible member adhered to said movable member in the direction of movement, discontinuity sensing means for determining whether or not a discontinuous portion, in which a distance between nearby marks does not lie in a preselected range, is present in a sensing region assigned to said mark sensing means, and speed/position control means for controlling either one of a speed and a position by using an output of said mark sensing means and for varying speed control or position control in accordance with an output of said discontinuity sensing means.

36. The apparatus as claimed in claim 35, wherein the flexible member functions as a guide member for preventing said movable member from being displaced in a direction perpendicular to the direction of movement.

37. A drive control device for controlling drive of an endless movable member, said drive control device comprising:

mark sensing means for sensing a plurality of marks continuously positioned on the movable member at preselected intervals in a direction of movement of said movable member;

discontinuity mark sensing means for sensing discontinuity marks positioned on said movable member and indicative of a position, in the direction of movement, of a discontinuous portion in which a distance between nearby marks does not lie in a preselected range;

speed/position control means for controlling either one of a speed and a position with a control signal based on an output of said mark sensing means and for varying speed control or position control in accordance with an output of said discontinuity mark sensing means; and dummy signal generating means for determining a mean value of intervals of outputs of said mark sensing means derived from a continuous portion, in which the distance between nearby marks lies in the preselected range, to thereby generate a dummy signal which repeats at said mean value, wherein, when the discontinuous portion is present in the sensing region of said mark sensing means, said speed/position control means executes the speed control or the position control by using the dummy signal in place of the output of said mark sensing means.

38. A drive control device for controlling drive of an endless movable member, said drive control device comprising:

mark sensing means for sensing a plurality of marks continuously positioned on the movable member at preselected intervals in a direction of movement of said movable member;

discontinuity mark sensing means for sensing discontinuity marks positioned on said movable member and indicative of a position, in the direction of movement, of a discontinuous portion in which a distance between nearby marks does not lie in a preselected range; and speed/position control means for controlling either one of a speed and a position with a control signal based on an output of said mark sensing means and for varying speed control or position control in accordance with an output of said discontinuity mark sensing means, said speed/position control means including memory means for storing a content of an output of said mark sensing means when a continuous portion, in which the distance between nearby marks lies in the preselected range, is present in a sensing region of said mark sensing means, wherein when the discontinuous portion is present in the sensing region of said mark sensing means, said speed/position control means executes speed control or position control in a manner different from when the continuous portion is present in said sensing region, and when the discontinuous portion is present in the sensing region of said mark sensing means, said speed/position control means executes the speed control or the position control by using a dummy signal in place of the output of said mark sensing means.

39. The device as claimed in claim 38, wherein the content stored in said memory means is based on an interval between signals output from said mark sensing means.

40. A drive control device for controlling drive of an endless movable member, said drive control device comprising:

mark sensing means for sensing a plurality of marks continuously positioned on the movable member at preselected intervals in a direction of movement of said movable member;

discontinuity mark sensing means for sensing discontinuity marks positioned on said movable member and indicative of a position, in the direction of movement, of a discontinuous portion in which a distance between nearby marks does not lie in a preselected range; and speed/position control means for controlling either one of a speed and a position with a control signal based on an output of said mark sensing means and for varying speed control or position control in accordance with an output of said discontinuity mark sensing means, said speed/position control means including a frequency signal generating means for generating a frequency signal based on the output of said mark sensing means, wherein said speed/position control means executes the speed control or the position control by using the frequency signal, and said speed/position control means causes said frequency signal generating means to generate, when the continuous portion is present in the sensing region of said mark sensing means, a frequency signal whose frequency is based on the output of said mark sensing means or generate, when the discontinuous portion is present in said sensing region, a frequency signal based on a signal different from said output of said mark sensing means and substantially identical in frequency with said frequency signal.

41. A drive control device for controlling drive of an endless movable member, said drive control device comprising:

mark sensing means for sensing a plurality of marks continuously positioned on the movable member at preselected intervals in a direction of movement of said movable member, said mark sensing including a plurality of mark sensors spaced from each other, in the direction of movement of said movable member, by a distance greater than a length of a discontinuous portion in which a distance between nearby marks does not lie in a preselected range;

discontinuity mark sensing means for sensing discontinuity marks positioned on said movable member and indicative of a position, in the direction of movement, of the discontinuous portion; and speed/position control means for controlling either one of a speed and a position with a control signal based on an output of said mark sensing means for varying speed control or position control in accordance with an output of said discontinuity mark sensing means, said speed/position control means including phase comparing means for comparing phases of output periods of said mark sensing means, wherein said speed/position control means executes the speed control or the position control by using an output of one of said plurality of mark sensors not sensing the discontinuous portion, and said speed/position control means uses, as for at least one of said mark sensors, an output corrected by a phase difference derived from a result of comparison executed by said phase comparing means.

42. A drive control device for controlling drive of an endless movable member, said drive control device comprising:

mark sensing means for sensing a plurality of marks continuously positioned on the movable member at preselected intervals in a direction of movement of said movable member, said mark sensing means including a plurality of mark sensors spaced each from other, in the direction of movement of said movable member, by a distance greater than a length of a discontinuous portion in which a distance between nearby marks does not lie in a preselected range;

discontinuity mark sensing means for sensing discontinuity marks positioned on said movable member and indicative of a position, in the direction of movement, of the discontinuous portion; and speed/position control means for controlling either one of a speed and a position with a control signal based on an output of said mark sensing means and for varying speed control or position control in accordance with an output of said discontinuity mark sensing means, said speed/position control means including ORing means for producing an OR of outputs of said mark sensors substantially matched in phase to each other, and including inhibiting means for inhibiting said ORing means from using the output of one of said mark sensors sensing the discontinuous portion, wherein said speed/position control means executes the speed control or the position control by using the OR output from said ORing means.

* * * * *